US011518640B2

(12) United States Patent
Nakahata et al.

(10) Patent No.: US 11,518,640 B2
(45) Date of Patent: Dec. 6, 2022

(54) MEDIUM DISCHARGE DEVICE, MEDIUM PROCESSING APPARATUS, AND RECORDING SYSTEM

(71) Applicant: SEIKO EPSON CORPORATION, Tokyo (JP)

(72) Inventors: Akinobu Nakahata, Shiojiri (JP); Tsuyoshi Furumido, Shiojiri (JP); Masaki Miyazawa, Matsumoto (JP); Kenji Uchibori, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 230 days.

(21) Appl. No.: 16/885,557

(22) Filed: May 28, 2020

(65) Prior Publication Data

US 2020/0377323 A1 Dec. 3, 2020

(30) Foreign Application Priority Data

May 30, 2019 (JP) ..... JP2019-101043

(51) Int. Cl.
*B65H 29/70* (2006.01)
*B65H 31/02* (2006.01)
(Continued)

(52) U.S. Cl.
CPC ..... *B65H 29/70* (2013.01); *B41J 13/106* (2013.01); *B65H 29/46* (2013.01); *B65H 31/02* (2013.01);
(Continued)

(58) Field of Classification Search
CPC ..... B65H 29/16; B65H 29/18; B65H 29/24; B65H 29/241; B65H 29/242; B65H 29/38; B65H 29/46; B65H 29/70; B65H 31/02; B65H 31/26; B65H 2404/691; B65H 2404/693; B65H 2405/11151; B65H 2405/1116; B65H 2405/11161;
(Continued)

(56) References Cited

U.S. PATENT DOCUMENTS 7,520,505 B2 * 4/2009 Thomas ..... B65H 29/14 271/220
8,991,817 B1 * 3/2015 Terao ..... B65H 29/70 271/209
(Continued)

FOREIGN PATENT DOCUMENTS

CN 107499976 12/2017
JP H11-199115 7/1999
(Continued)

*Primary Examiner* — Prasad V Gokhale
(74) *Attorney, Agent, or Firm* — Workman Nydegger

(57) ABSTRACT

A medium discharge includes a first tray having a first medium receiving surface, a second tray having a second medium receiving surface for receiving the medium discharged from the first tray, a discharge section that discharges the medium disposed on the first tray to the second tray, and a push-down portion that is located downstream of a downstream end of the first medium receiving surface in the medium discharge direction, and that is located at a place deviated from the discharge section in a width direction that is a direction intersecting with the medium discharge direction, and pushes down a part of an upstream end of the medium to be discharged in the medium discharge direction.

15 Claims, 20 Drawing Sheets

(51) Int. Cl.
*B41J 13/10* (2006.01)
*B65H 31/26* (2006.01)
*B65H 29/46* (2006.01)

(52) U.S. Cl.
CPC ..... *B65H 31/26* (2013.01); *B65H 2301/4212* (2013.01); *B65H 2404/693* (2013.01); *B65H 2405/11151* (2013.01); *B65H 2405/11164* (2013.01); *B65H 2405/3322* (2013.01); *B65H 2406/323* (2013.01); *B65H 2801/27* (2013.01)

(58) Field of Classification Search
CPC ..... B65H 2405/11164; B65H 2406/32; B65H 2406/323; B65H 2801/27
See application file for complete search history.

(56) References Cited

U.S. PATENT DOCUMENTS

| | | | | |
|---|---|---|---|---|
| 2007/0069453 | A1* | 3/2007 | Thomas | B65H 29/14 271/207 |
| 2008/0315494 | A1 | 12/2008 | Terao et al. | |
| 2015/0151944 | A1 | 6/2015 | Shirasaki et al. | |
| 2016/0082750 | A1* | 3/2016 | Boo | B41J 13/106 347/104 |
| 2017/0355541 | A1* | 12/2017 | Koyama | B65H 1/04 |
| 2019/0062088 | A1 | 2/2019 | Koyama | |
| 2019/0225448 | A1* | 7/2019 | Kotani | B65H 31/26 |

FOREIGN PATENT DOCUMENTS

| | | | |
|---|---|---|---|
| JP | 2011-246283 | A | 12/2011 |
| JP | 2015-107840 | A | 6/2015 |

* cited by examiner

MEDIUM DISCHARGE DEVICE, MEDIUM PROCESSING APPARATUS, AND RECORDING SYSTEM

The present application is based on, and claims priority from JP Application Serial Number 2019-101043, filed May 30, 2019, the disclosure of which is hereby incorporated by reference herein in its ultimately.

BACKGROUND

1. Technical Field

The present disclosure relates to a medium discharge device for discharging a medium, a medium processing apparatus including the medium discharge device, and a recording system including the medium discharge device.

2. Related Art

In a medium processing apparatus that performs processing such as stapling processing and punching processing on a medium, for example, there is a medium processing apparatus including a medium discharge device that stacks a medium in a first tray with its ends aligned, performs processing on stacked medium and discharges the processed medium to a second tray. Such a medium processing apparatus may be incorporated in a recording system capable of continuously executing from recording on a medium in a recording apparatus represented by an ink jet printer to post-processing such as stapling processing on the medium after recording.

As an example of such a medium processing apparatus, JP-A-2015-107840 and JP-A-2011-246283 disclose a medium processing apparatus configured to perform stapling processing on a plurality of media stacked on a processing tray and discharge the processed medium onto a stacking tray.

In the configuration described in JP-A-2015-107840, when the processed medium is discharged from the processing tray to the stacking tray, the rear end of the processed medium may be caught on the processing tray and may not be properly discharged to the stacking tray.

Further, in the configuration described in JP-A-2015-107840, in order to discharge the medium after processing from the processing tray to the stacking tray, when the medium is pushed out by a pushing member and the pushing member is returned to the processing tray, the processed medium may be pulled back to the processing tray together with the pushing member, and may not be properly discharged to the stacking tray.

SUMMARY

According to an aspect of the present disclosure, there is provided a medium discharge device including a first tray having a first medium receiving surface for receiving a medium, a second tray having a second medium receiving surface for receiving the medium discharged from the first tray, a discharge section that discharges the medium disposed on the first tray to the second tray, and a push-down portion that is located downstream of a downstream end of the first medium receiving surface in a medium discharge direction, and that is located at a place deviated from the discharge section in a width direction that is a direction intersecting with the medium discharge direction, and pushes down a part in the width direction of an upstream end of the medium to be discharged in the medium discharge direction below the downstream end of the first medium receiving surface in the medium discharge direction.

DESCRIPTION OF EXEMPLARY EMBODIMENTS

Figure 1:
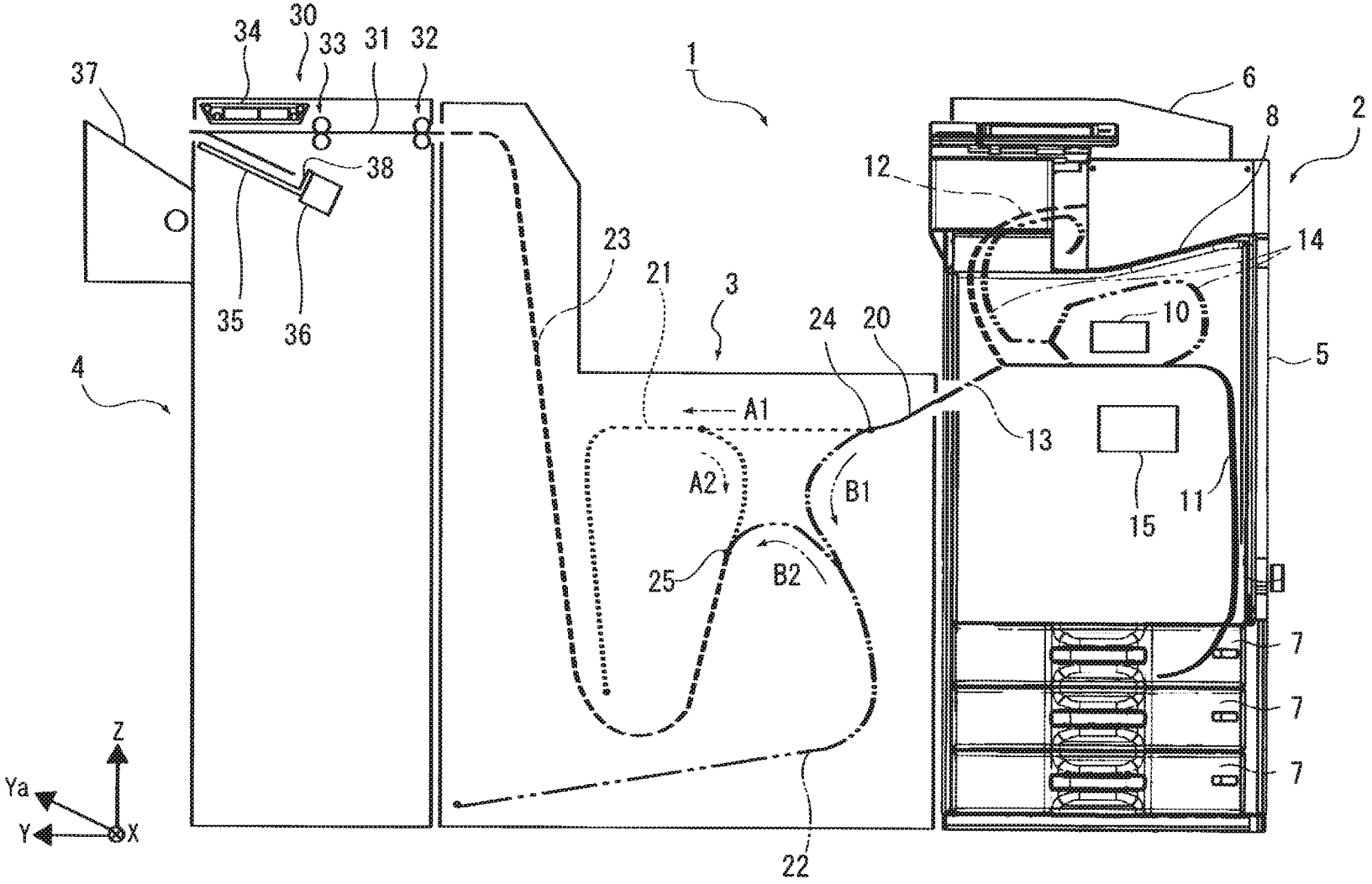
FIG. 1 is a schematic view of a recording system.

Hereinafter, the present disclosure will be schematically described.

A medium discharge device according to a first aspect includes a first tray having a first medium receiving surface for receiving a medium, a second tray having a second medium receiving surface for receiving the medium discharged from the first tray, a discharge section that discharges the medium disposed on the first tray to the second tray, and a push-down portion that is located downstream of a downstream end of the first medium receiving surface in a medium discharge direction, and that is located at a place deviated from the discharge section in a width direction that is a direction intersecting with the medium discharge direction, and pushes down a part in the width direction of an upstream end of the medium to be discharged in the medium discharge direction below the downstream end of the first medium receiving surface in the medium discharge direction.

Further, the discharge section has a support portion that supports the medium and is displaceable between a retracted position located in the first tray and an advanced position advanced from the retracted position in the medium discharge direction from the first tray to the second tray and is located on the second tray, and the push-down portion pushes down the medium supported by the support portion located at the advanced position.

According to this aspect, a push-down portion that pushes down a part of an upstream end of the medium to be discharged in the medium discharge direction below the downstream end of the first medium receiving surface in the width direction by pushing down the medium supported by the support portion positioned at the advanced position, so that when discharging the medium from the first tray to the second tray, it is possible to suppress a problem that the upstream end of the medium in the medium discharge direction is caught by the downstream end of the first medium receiving surface in the medium discharging direction. Further, when returning the support portion from the advanced position to the retracted position, the medium supported by the support unit can be prevented from being pulled back to the first tray, and the medium can be properly dropped on the second tray.

In a second aspect based on the first aspect, the push-down portion is configured to displace between a lowered position for pushing down a part in the width direction of the upstream end of the medium in the medium discharge direction to below the downstream end of the first medium receiving surface in the medium discharge direction and a raised position which is a position above the lowered position and which is separated from the medium supported by the support portion located at the advanced position, and the raised position is a position above a height position of the downstream end of the first medium receiving surface in the medium discharging direction.

According to this aspect, since the raised position of the push-down portion is a position above the height position of the downstream end of the first medium receiving surface in the medium discharge direction, when the medium is moved from the first tray toward the second tray, it is possible to prevent the push-down portion from being in the way.

In a third aspect based on the second aspect, the push-down portion is provided on both sides of the support portion in the width direction.

According to this aspect, since the push-down portions are provided on both sides of the support portion in the width direction, the problem that the upstream end of the medium in the medium discharge direction is caught on the downstream end of the first medium receiving surface in the medium discharge direction when the medium is discharged from the first tray to the second tray can be more reliably suppressed.

In a fourth aspect based on the second or third aspect, the push-down portion is displaced from the raised position to the lowered position after the support portion is displaced from the retracted position to the advanced position, and is displaced from the lowered position to the raised position after the support portion is displaced from the advanced position to the retracted position.

According to this aspect, since the push-down portion is displaced from the raised position to the lowered position after the support portion is displaced from the retracted position to the advanced position, and is displaced from the lowered position to the raised position after the support portion is displaced from the advanced position to the retracted position, the medium can be reliably dropped on the second tray.

In a fifth aspect based on any one of the second to fourth aspects, a holding member that holds the push-down portion and is configured to be displaced along a displacement direction between the raised position and the lowered position, in which the push-down portion is provided so as to be displaceable with respect to the holding member along the displacement direction between the raised position and the lowered position and is pressed by a pressing member in a direction toward the lowered position.

According to this aspect, the push-down portion is provided so as to be displaceable with respect to the holding member along the displacement direction between the raised position and the lowered position and is pressed by a pressing member in a direction toward the lowered position. Therefore, the push-down portion can suppress excessively strong pressing against the medium, in particular, when the rigidity of the medium is high and it is difficult to bend, or when the stacking amount of the medium is large, the medium can be pushed down appropriately.

In a sixth aspect based on any one of the second to fourth aspects, in which a holding member that holds the push-down portion and is configured to be displaced along a displacement direction between the raised position and the lowered position and a driving section that displaces the holding member along the displacement direction are provided.

According to this aspect, a holding member that holds the push-down portion and is configured to be displaced along a displacement direction between the raised position and the lowered position and a driving section that displaces the holding member along the displacement direction are provided, so that the raised position and the lowered position of the push-down portion can be adjusted according to the situation. For example, when the rigidity of the medium is high and it is difficult to bend, or when the stacking amount of the medium is large, the lowered position is set to be higher than other cases, so that the push-down portion can be prevented from pressing against the medium excessively strongly, and the medium can be pushed down appropriately.

In a seventh aspect based on any one of the second to sixth aspects, the push-down portion is displaceable to a first restriction position that restricts floating of the medium mounted on the first tray, and every time the medium is discharged to the first tray, the push-down section is displaced from the raised position to the first restriction position.

According to this aspect, the push-down portion is displaceable to a first restriction position that restricts floating of the medium mounted on the first tray, and every time the medium is discharged to the first tray, the push-down section is displaced from the raised position to the first restriction position. Accordingly, floating of the medium discharged to the first tray can be appropriately restricted.

In an eighth aspect based on the seventh aspect, the first restriction position is a position above the lowered position and is above an extension of the first medium receiving surface extending in the medium discharge direction.

According to this aspect, the first restriction position is a position above the lowered position and is above an extension of the first medium receiving surface extending in the medium discharge direction, so that applying an excessive external force to the medium discharged to the first tray can be suppressed.

In a ninth aspect based on any one of the second to eighth aspects further includes a restriction member configured to take a first state which faces upstream area of the medium mounted on the second receiving surface of the second tray in the medium discharge direction and restricts floating of the upstream area and a second state separated from a position facing the medium mounted on the second medium receiving surface of the second tray.

According to this aspect, a restriction member configured to take a first state which faces upstream area of the medium mounted on the second receiving surface of the second tray in the medium discharge direction and restricts floating of the upstream area and a second state separated from a position facing the medium mounted on the second medium receiving surface of the second tray is provided. Therefore, even after the push-down portion returns to the raised position, the floating of the medium mounted on the second tray can be restricted.

In a tenth aspect based on any one of the second to ninth aspects, the raised position of the push-down portion is set to a position obtained by adding a predetermined margin to a maximum stacking height of the medium on the first tray.

According to this aspect, since the raised position of the push-down portion is set to a position obtained by adding a predetermined margin to a maximum stacking height of the medium on the first tray, the raised position is set to a minimum necessary height, so that the time required for the displacement of the push-down portion can be suppressed, and thus the throughput can be suppressed.

In an eleventh aspect based on any one of the second to tenth aspects, the support portion is in a non-projecting state from the downstream end of the first medium receiving surface in the medium discharge direction at the retracted position.

According to this aspect, since the support portion is in a non-projecting state from the downstream end of the first medium receiving surface in the medium discharge direction at the retracted position, when the medium is discharged from the first tray to the second tray, it is possible to prevent the upstream end of the medium in the medium discharge direction from being caught on the support portion.

In a twelfth aspect based on any one of the second to eleventh aspects, the push-down portion has a shape in which the upstream end in the medium discharge direction is warped upward.

According to this aspect, since the push-down portion has a shape in which the upstream end in the medium discharge direction is warped upward, when discharging the medium to the first tray or when moving the medium mounted on the first tray by the support portion downstream in the medium discharge direction, the possibility that the downstream end of the medium in the medium discharge direction is caught by the push-down portion can be suppressed.

In a thirteenth aspect based on the second aspect according to any one of the second to twelfth aspects, the push-down portion is configured to take a second restriction position further lowered from the lowered position, and capable of restricting floating of the medium mounted on the second tray.

According to this aspect, the push-down portion is configured to take a second restriction position further lowered from the lowered position, and capable of restricting floating of the medium mounted on the second tray, so that the floating of the medium in the second tray can be appropriately restricted.

According to a fourteenth aspect, in the thirteenth aspect, the push-down portion faces an upstream area of the medium mounted on the second medium receiving surface of the second tray in the medium discharge direction.

According to this aspect, since the push-down portion faces an upstream area of the medium mounted on the second medium receiving surface of the second tray in the medium discharge direction, the floating of the medium mounted on the second medium receiving surface of the second tray in the upstream area in the medium discharge direction can be suitably restricted.

A medium processing apparatus according to a fifteenth aspect includes the medium discharge device according to any one of the first to fourteenth aspects and a processing portion that performs a predetermined process on the medium mounted on the first tray.

According to this aspect, in the medium processing apparatus, the same operation and effect as any of the first to fourteenth aspects can be obtained.

A recording system according to a sixteenth aspect includes a recording unit including a recording section that performs recording on a medium, and a processing unit including the medium discharge device according to any one of the first to fourteenth aspects that discharges the medium after recording in the recording unit and a processing portion that performs a predetermined processing on the medium mounted on the first tray.

According to this aspect, in the recording system, the same operation and effect as any of the first to fourteenth aspects can be obtained.

Hereinafter, the present disclosure will be described specifically.

The X-Y-Z coordinate system shown in each figure is a rectangular coordinate system, and the X-axis direction is the width direction of the medium and also the depth of the device. The Y-axis direction is the device width direction, and the Z-axis direction is the vertical direction, that is, the device height direction. Further, the Ya-axis direction indicates a medium feeding direction in a medium discharge device 30 described later, and in the present embodiment, the +Ya direction and the +Y direction form an acute angle. The +Ya direction of the Ya-axis direction is the medium discharge direction in the medium discharge device 30 and is downstream in the medium discharge direction. The −Ya direction is the opposite direction to the medium discharge direction in the medium discharge device 30 and is upstream in the medium discharge direction.

A recording system 1 shown in FIG. 1 includes, as an example, a recording unit 2, an intermediate unit 3, and a processing unit 4 in order from right to left in FIG. 1.

The recording unit 2 includes a line head 10 as a "recording section" for recording on a medium. The medium includes a recording sheet as an example, and the medium is hereinafter referred to as a medium P.

The intermediate unit 3 receives the medium P after recording from the recording unit 2 and transfers the medium P to a processing unit 4. The processing unit 4 includes a medium discharge device 30 that discharges the medium P after recording in the recording unit 2, and a processing portion 36 that performs a predetermined process on the medium P mounted on a first tray 35 of the medium discharge device 30.

In the recording system 1, the recording unit 2, the intermediate unit 3, and the processing unit 4 are coupled to each other so that the medium P can be transported from the recording unit 2 to the processing unit 4.

The recording system 1 is configured to input a recording operation on the medium P in the recording unit 2, the intermediate unit 3, and the processing unit 4 from an operation panel (not shown). The operation panel can be provided in the recording unit 2 as an example.

Hereinafter, the schematic configurations of the recording unit 2, the intermediate unit 3, and the processing unit 4 will be described in this order.

The recording unit 2 shown in FIG. 1 is configured as a multifunction machine including a printer portion 5 including the line head 10 that performs recording by ejecting ink, which is an example of a liquid, onto a medium P, and a scanner portion 6. In the present embodiment, the printer portion 5 is configured as a so-called ink jet printer.

A plurality of medium accommodation cassettes 7 are provided below the recording unit 2. The medium P accommodated in the medium accommodation cassette 7 is sent to the recording area by the line head 10 through the transport path 11 indicated by a solid line in the recording unit 2 in FIG. 1 and the recording operation is performed. The medium P after recording by the line head 10 is sent to either a first discharge path 12 which is a path for discharging the medium P to a post-recording discharge tray 8 provided above the line head 10 or a second discharge path 13 which is a path for sending the medium P to the intermediate unit 3. In the recording unit 2 of FIG. 1, the first discharge path 12 is indicated by a broken line, and the second discharge path 13 is indicated by a dashed line.

The recording unit 2 includes a reversing path 14 indicated by a two-dot chain line, and is configured to perform double-sided recording in which the medium P is reversed and recording is performed on the second surface after recording on the first surface of the medium P.

In each of the transport path 11, the first discharge path 12, the second discharge path 13, and the reversing path 14, one or more pairs of transport rollers (not shown) are disposed as an example of a section that transports the medium P.

The recording unit 2 is provided with a control portion 15 that controls operations related to the transport and recording of the medium P in the recording unit 2. The control portion 15 can be configured to control not only the recording unit 2 but also various operations in the processing unit 4 described below.

The intermediate unit 3 is disposed between the recording unit 2 and the processing unit 4, is configured to receive the medium P after recording transferred from the second discharge path of the recording unit 2 via a receiving path 20, and transport the medium P to the processing unit 4. The receiving path 20 is indicated by a solid line in the intermediate unit 3 shown in FIG. 1.

In the intermediate unit 3, there are two transport paths for transporting the medium P. The first transport path is a path for the medium P to be transported from the receiving path 20 via a first switchback path 21 to a discharge path 23. The second path is a path for the medium P to be transported from the receiving path 20 via a second switchback path 22 to the discharge path 23.

The first switchback path 21 is a path for receiving the medium in the direction of arrow A1 and then switching back the medium P in the direction of arrow A2. The second switchback path 22 is a path for receiving the medium in the direction of arrow B1 and then switching back the medium in the direction of arrow B2.

The receiving path 20 branches into the first switchback path 21 and the second switchback path 22 at a branching portion 24. Further, the first switchback path 21 and the second switchback path 22 join at a junction 25. Therefore, even if the medium P is sent from the receiving path 20 to any of the switchback paths, the medium P can be transferred to the processing unit 4 from the common discharge path 23.

In each of the receiving path 20, the first switchback path 21, the second switchback path 22, and the discharge path 23, one or more transport roller pairs (not shown) are disposed.

When recording is continuously performed on a plurality of media P in the recording unit 2, the medium P that has entered the intermediate unit 3 is alternately sent to a transport path passing through the first switchback path 21 and a transport path passing through the second switchback path 22. As a result, it is possible to increase the medium transport throughput in the intermediate unit 3.

It is also possible to adopt a recording system in which the intermediate unit 3 is omitted. That is, the processing unit can be directly coupled to the recording unit 2.

When the medium P after recording in the recording unit 2 is sent to the processing unit 4 via the intermediate unit 3, the transport time is longer than when the medium P is sent directly from the recording unit 2 to the processing unit 4, so that the ink of the medium P can be further dried before being transported to the processing unit 4.

The processing unit 4 includes the medium discharge device 30 that discharges the medium P received from the intermediate unit 3. The medium discharge device 30 includes the first tray 35 and a second tray 37, and is configured to perform processing on the medium discharged to the first tray 35 in the processing portion 36 and discharge the medium to the second tray 37. Examples of the processing performed by the processing portion 36 include a stapling processing and a punching processing. In the present embodiment, the medium discharge device 30 discharges the medium P that has been transferred from the discharge path 23 of the intermediate unit 3 and transported through the transport path 31.

The processing unit 4 includes a first transport roller pair 32 and a second transport roller pair 33 that transport the medium P in the +Y direction, and transports the medium P toward the medium discharge device 30.

Figure 2:
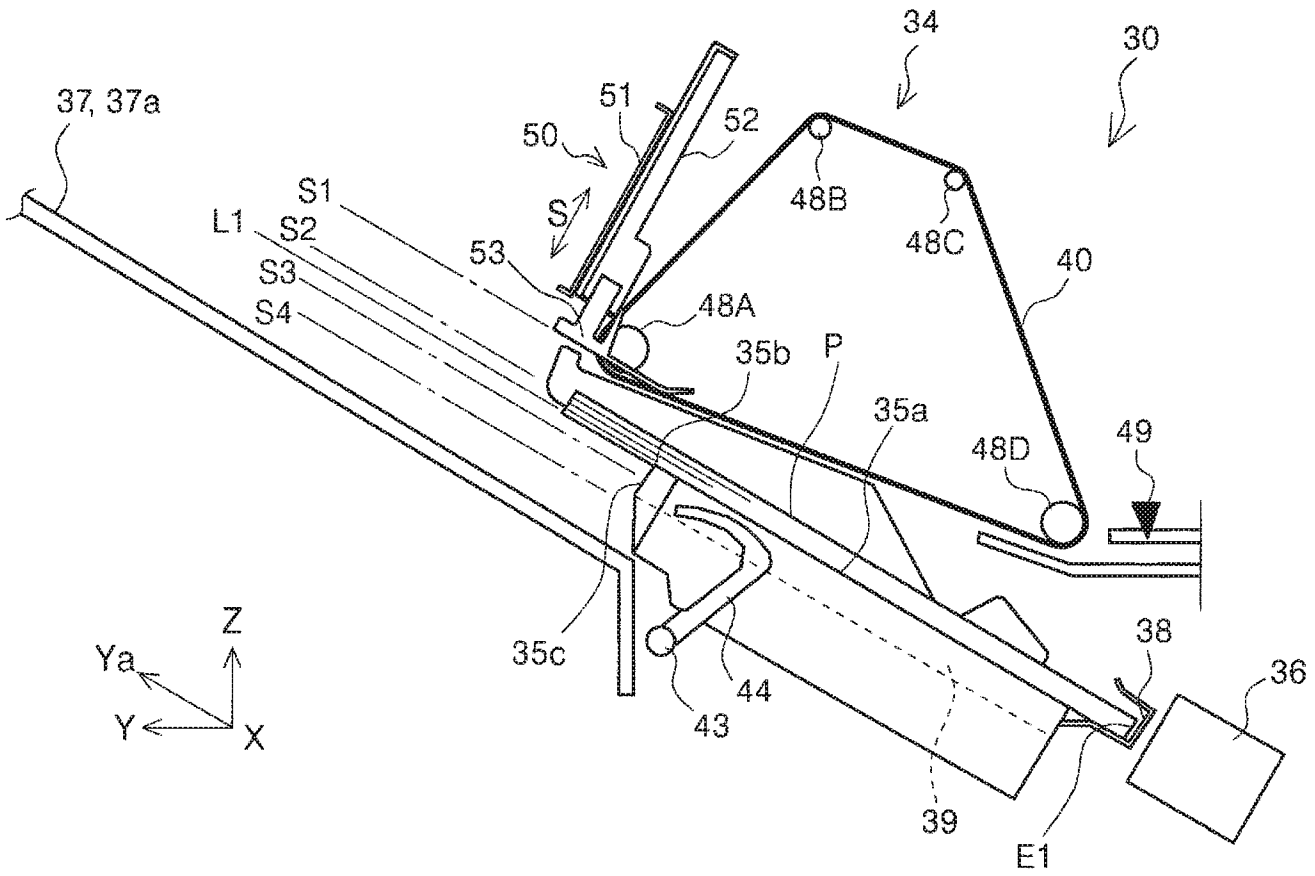
FIG. 2 is a side view of a medium discharge device.

In the +Y direction with respect to the second transport roller pair 33, a transport section 34 constituting the medium discharge device 30 is disposed. The transport section 34 transports the medium P by a transport belt 40 as shown in FIG. 2. The transport section 34 is configured to transport the medium P in both the +Ya direction and the −Ya direction.

More specifically, the transport belt 40 in the transport section 34 is configured to transport the medium P in the +Ya direction and the −Ya direction by rotation while adsorbing the medium P. The transport belt 40 is disposed above the transported medium P. That is, the transport belt 40 is configured to transport the medium P by adsorbing from above.

The annular transport belt 40 is wound around four rollers of a first roller 48A, a second roller 48B, a third roller 48C, and a fourth roller 48D. The fourth roller 48D is configured to be rotatable both clockwise and counterclockwise in FIG. 2 by the power of a driving source (not shown).

When the fourth roller 48D rotates clockwise, the transport belt 40 also rotates clockwise, and the medium P adsorbed on the transport belt 40 is transported in the +Ya direction. Conversely, when the fourth roller 48D rotates counterclockwise, the transport belt 40 also rotates counterclockwise, and the medium P adsorbed on the transport belt 40 is transported in the −Ya direction.

The transport belt 40 has a plurality of suction holes (not shown) formed therein, and a suction fan (not shown) generates a negative pressure in the suction holes, whereby the medium P is adsorbed on the belt surface of the transport belt 40.

The transport belt 40 adsorbs the medium P transferred from the second transport roller pair 33 (see FIG. 1) to the transport belt 40 and transports the medium P in the +Ya direction. When a first end E1 of the medium P is transported to a predetermined position, the transport belt 40 transports the medium P in the −Ya direction. At this time, a separation member (not shown) separates the medium P from the transport belt 40, whereby the medium P falls onto the first tray 35 and is mounted. The suction of the medium P by the transport belt 40 is not limited to the suction adsorption type, but may be an electrostatic attraction type.

The first tray 35 is provided with a support portion 39 described later in detail. The first end E1 which is the −Ya direction end of the medium P that has fallen on a first medium receiving surface 35*a* of the first tray 35 comes into contact with an aligning portion 38, and the position thereof is aligned. When a plurality of media P are mounted on the first tray 35, the first end E1 is aligned by the aligning portion 38.

Although not shown, a plurality of aligning portions 38 are provided in the X-axis direction which is the width direction, and one of the centers is provided in the support portion 39.

Figure 3:
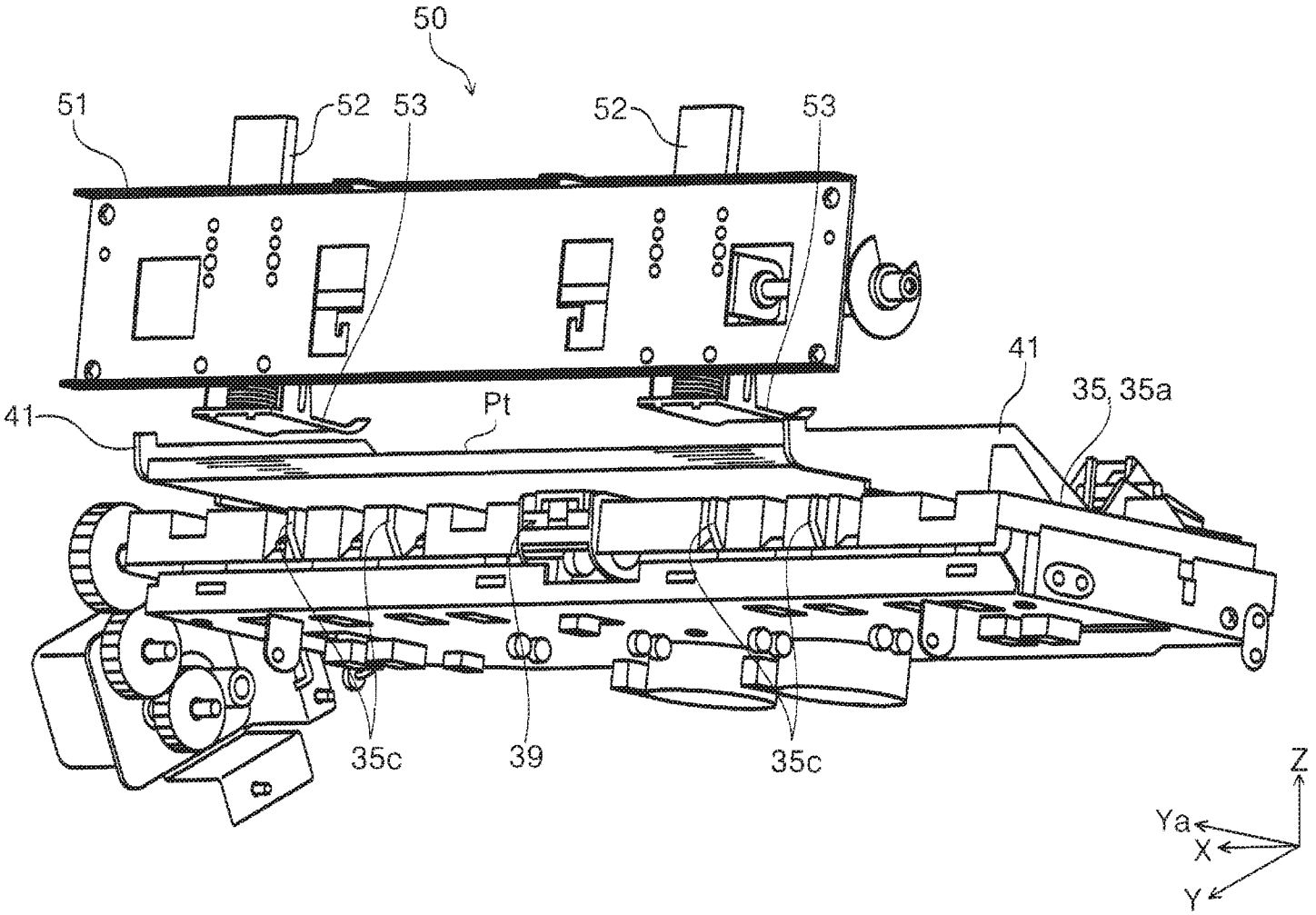
FIG. 3 is a perspective view of a holding section, a first tray, and a support portion.

As shown in FIG. 3, side cursors 41 are provided at the first tray 35 on both sides of the support portion 39 in the X-axis direction. The side cursors 41 abut on the end of the medium P mounted on the first tray 35 in the X-axis direction, and the end in the X-axis direction is aligned.

In the medium discharge device 30 shown in FIG. 2, processing such as a stapling processing is performed on one or a plurality of media P mounted on the first tray 35 with the first end E1 aligned with the aligning portion 38 by a processing portion 36 provided near the aligning portion 38. The medium P that has been processed by the processing portion 36 is moved to an upper portion of the second tray 37 by the support portion 39 described later, and falls onto the second tray 37. The detailed operation at this time will be described later.

Hereinafter, the discharge of the medium P from the first medium receiving surface 35*a* of the first tray 35 to a second medium receiving surface 37*a* of the second tray 37 by the support portion 39 will be described in more detail.

The support portion 39 provided in the first tray 35 is configured to be displaceable between a retracted position located in the first tray 35 as shown in FIGS. 2, 3, 7, 10, 11, 12, and 16, and an advanced position advanced in the +Ya direction from the retracted position and is located over the second tray 37 as shown in FIGS. 5, 6, 8, 9, and 18. The support portion 39 can support the medium P at both the retracted position and the advanced position. The above-described aligning portion 38 is provided on the support portion 39 and moves following the displacement of the support portion 39.

When the medium P is mounted on the first tray 35 by the transport belt 40, the support portion 39 is located at the retracted position. The support portion 39 at the retracted position supports the medium P together with the first medium support surface 35*a* of the first tray 35, and performs processing by the processing portion 36 on the medium P in this state. When discharging the medium P from the first tray 35 to the second tray 37, the support portion 39 moves from the retracted position to the advanced position in the +Ya direction. Since the aligning portion 38 moves together with the support portion 39, the medium P moves in the +Ya direction together with the support portion 39 and the aligning portion 38, and moves onto the second tray 37.

Here, the configuration of the support portion 39 will be described in detail.

The support portion 39 according to the present embodiment extends with a displacement from the retracted position to the advanced position. Since the support portion 39 extends with the displacement from the retracted position to the advanced position, the support portion 39 can be compactly disposed at the retracted position in the first tray 35, and the distance from the retracted position of the support portion 39 to the advanced position can be secured. Further, the support portion 39 can be in a non-projecting state from the first tray 35 at the retracted position, and the medium P can be reliably dropped on the second tray 37.

Figure 13:
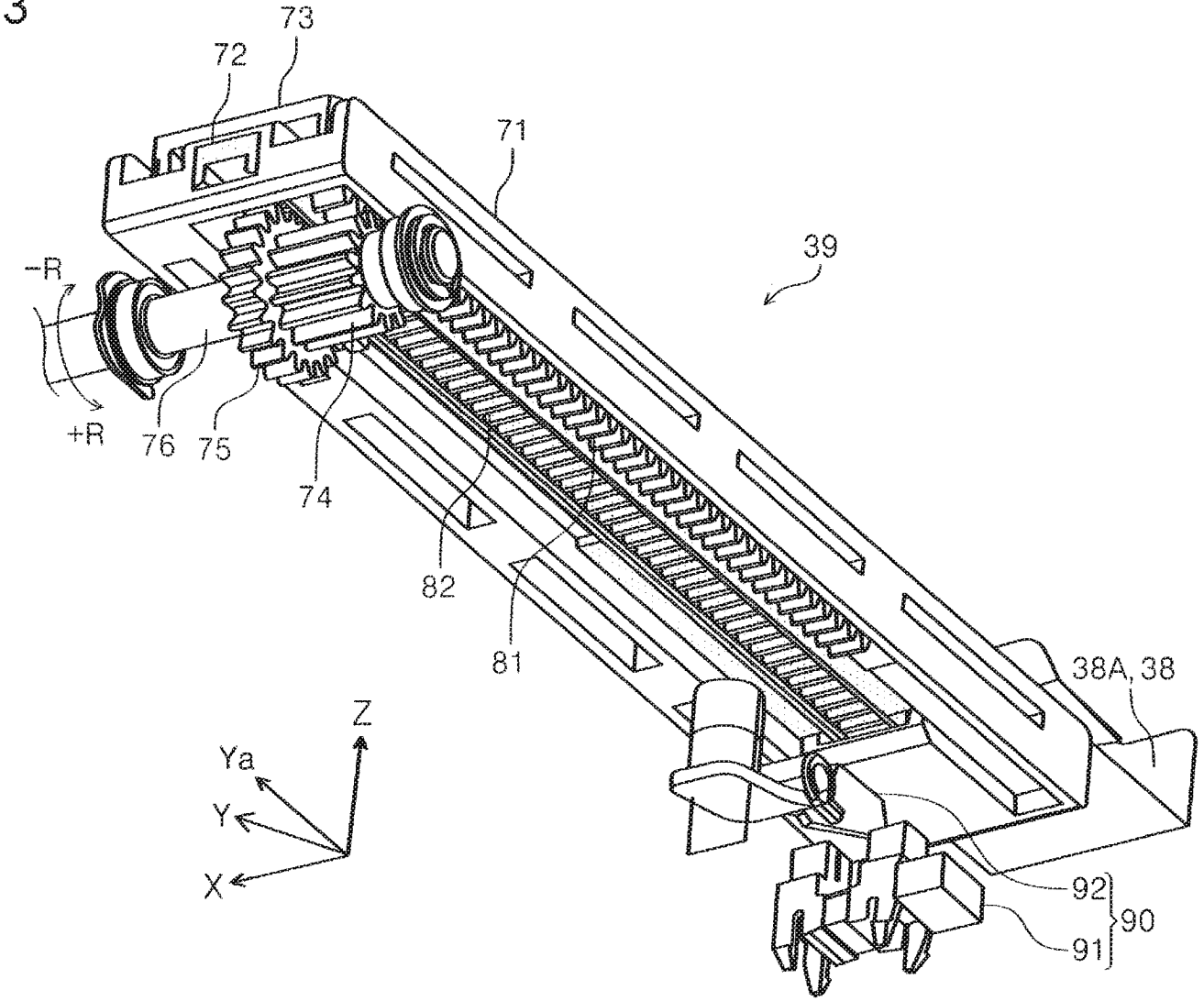
FIG. 13 is a perspective view of the support portion located at a retracted position as viewed from below.
Figure 14:
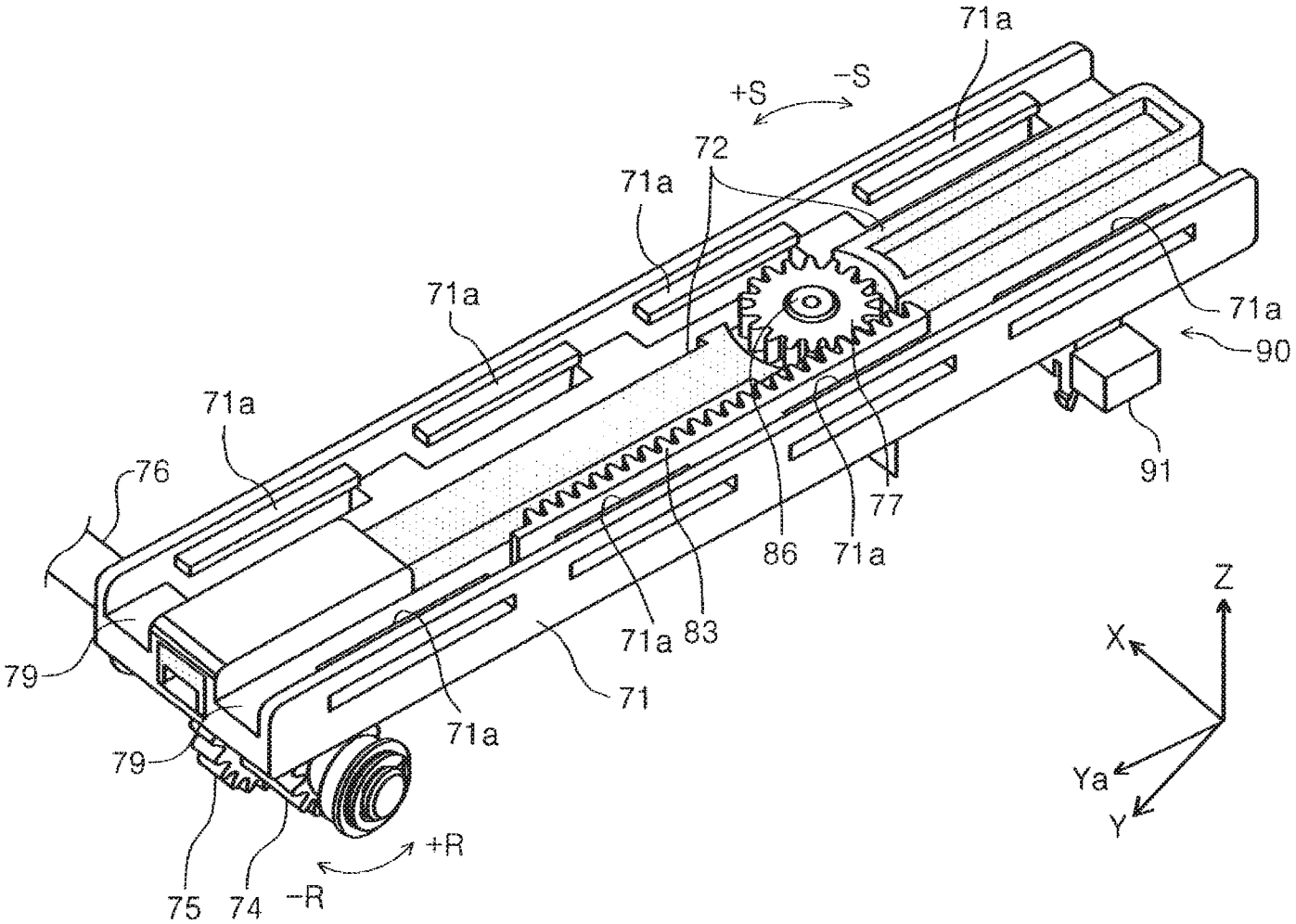
FIG. 14 is a perspective view showing a state in which a third member is removed from the support portion.

As shown in FIGS. 13 and 14, the support portion 39 includes a first member 71, a second member 72, a third member 73, a first gear 74, a second gear 75, and a pinion gear 77.

The first member 71 is slidable in the Ya-axis direction with respect to the first tray 35, and has a first rack 81 and a second rack 83 provided along the Ya-axis direction. The first member 71 is configured to slide with respect to a groove 78 (see FIGS. 17 and 18) extending in the Ya-axis direction in the first tray 35.

The second member 72 is slidable in the Y-axis direction with respect to the first member 71, and has a third rack 82 provided along the Ya-axis direction.

Figure 15:
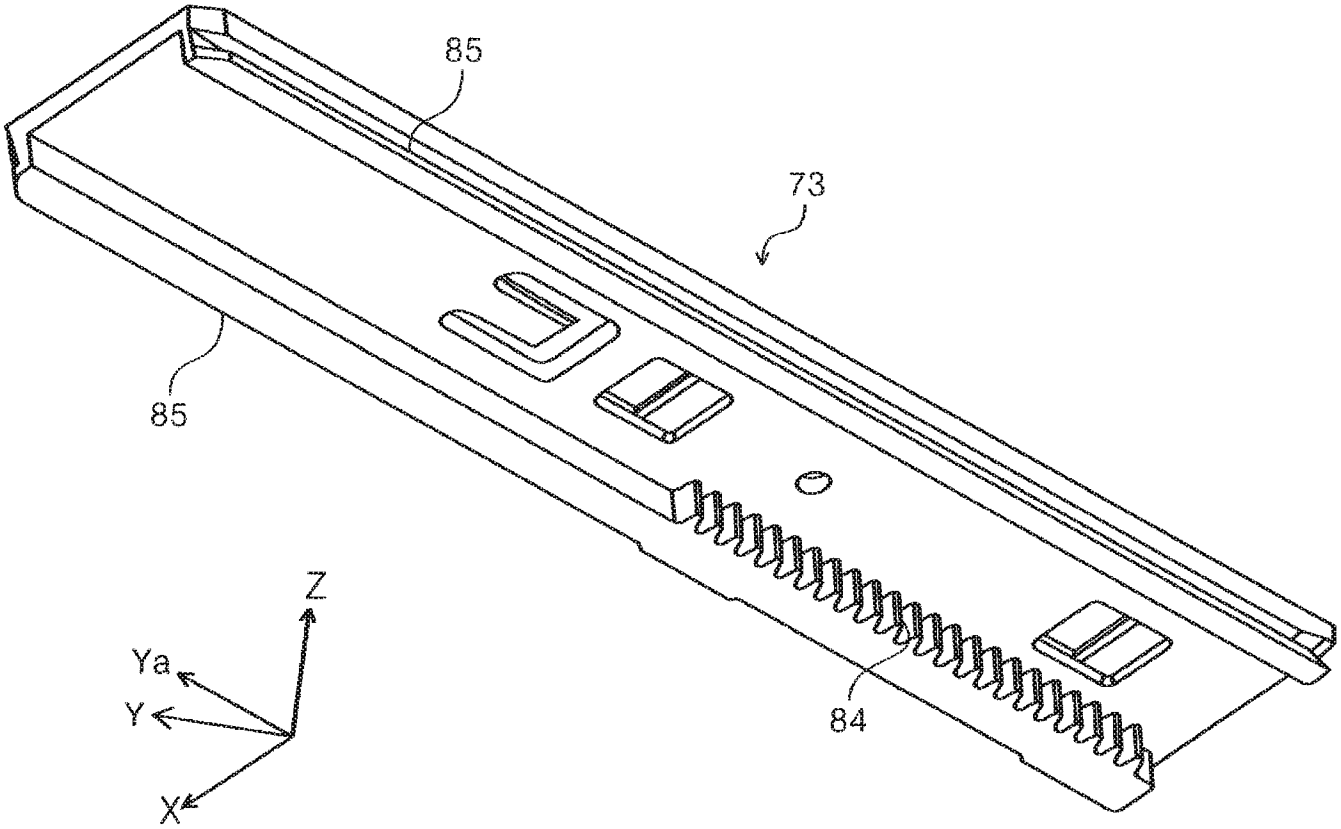
FIG. 15 is a perspective view of the third member viewed from below.
Figure 16:
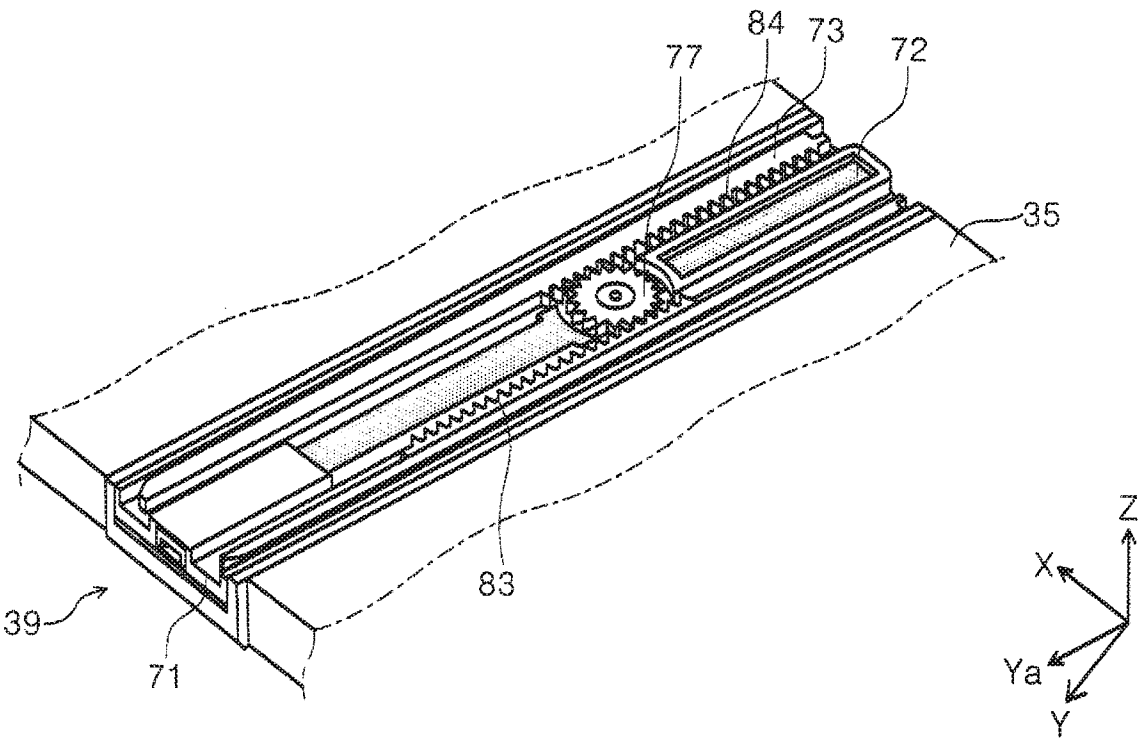
FIG. 16 is a perspective view showing a state in which the support portion provided on the first tray is located at a retracted position.
Figure 17:
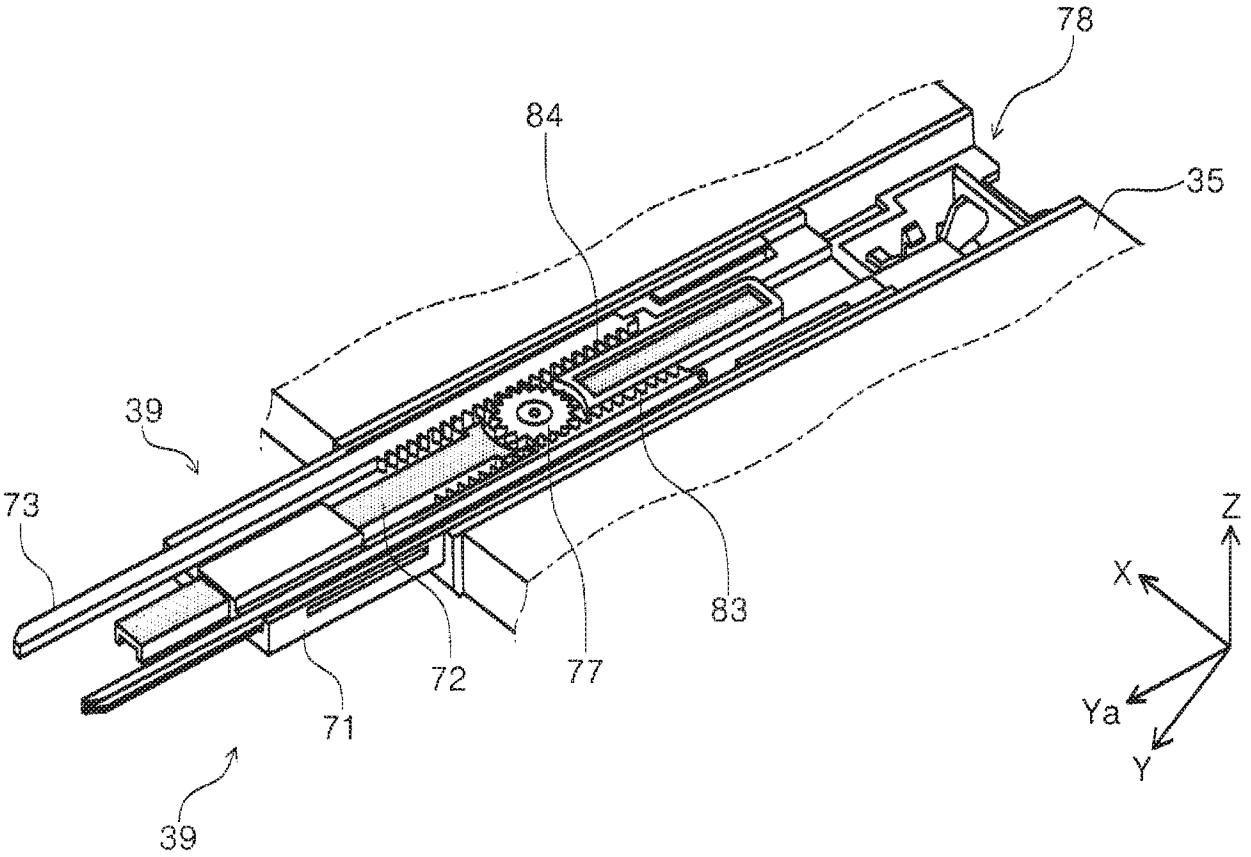
FIG. 17 is a perspective view showing a state in which the support portion provided on the first tray is located between a retracted position and an advanced position.
Figure 18:
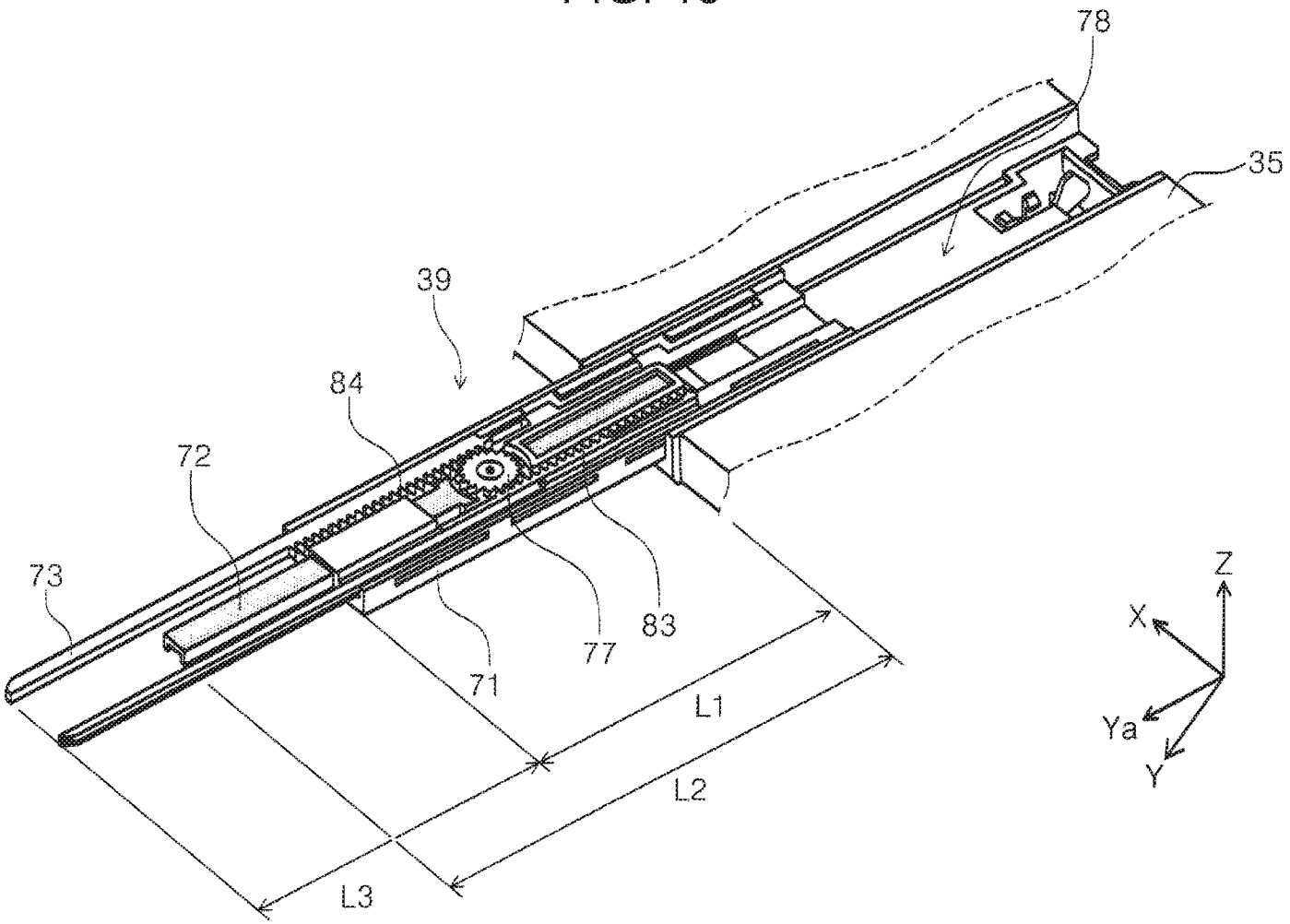
FIG. 18 is a perspective view illustrating a state in which the support portion provided on the first tray is located at an advanced position.

The third member 73 is slidable in the Ya-axis direction with respect to the first member 71, and has a fourth rack 84 as shown in FIG. 15. The third member 73 shown in FIG. 15 has guide portions 85 on both sides in the width direction. The guide portions 85 are guided by a protrusion 71*a* in the groove 79 of the first member 71 shown in FIG. 14, and the member 73 slides with respect to the first member 71. The fourth rack 84 is provided to face the second rack 83 of the first member 71 in the X-axis direction, which is a width direction intersecting the Ya-axis direction, as shown in FIGS. 16 to 18. The aligning portion 38 provided on the support portion 39 is provided on the third member 73, but is not shown in FIGS. 14 to 18 for convenience.

In the support portion 39 shown in FIG. 13, the first gear 74 meshes with the first rack 81. The second gear 75 has a larger number of teeth on the outer circumference than the first gear 74, and meshes with the third rack 82 to rotate integrally with the first gear 74. The first gear 74 and the second gear 75 are provided on the same rotation shaft 76. The first gear 74 and the second gear 75 rotate when the rotation shaft 76 is rotationally driven by the power of the driving source of a first motor 61 (see FIG. 19). The first gear 74 and the second gear 75 are rotatable in both the +R direction and the −R direction indicated by a double arrow in FIG. 13.

FIG. 13 shows a state in which the support portion 39 is at the retracted position, and the first gear 74 and the second gear 75 are provided at the end of the first tray 35 in the +Ya direction.

The pinion gear 77 shown in FIG. 14 has a rotation shaft 86 on the second member 72, and meshes with both the second rack 83 and the fourth rack 84 as shown in FIGS. 16 to 18.

When the first gear 74 and the second gear 75 shown in FIG. 13 are rotated in the +R direction from the state where the support portion 39 is in the retracted position, the support portion 39 starts moving in the +Ya direction toward the advanced position.

More specifically, when the first gear 74 and the second gear 75 are rotated in the +R direction, the first member 71 having the first rack 81 that meshes with the first gear 74 and the second member 72 having the third rack 82 that meshes with the second gear 75 move in the +Ya direction, respectively.

Since the second gear 75 has a larger number of teeth on the outer periphery than the first gear 74, the second member 72 moves faster than the first member 71. That is, a speed difference occurs between the first member 71 and the second member 72 that move.

When a speed difference occurs between the first member 71 and the second member 72, the pinion gear 77 having the rotation shaft 86 (see FIG. 14) in the second member 72 rotates. Thereby, the third member 73 can be slid with respect to the first member 71.

In FIG. 14, when the first gear 74 and the second gear 75 rotate in the +R direction, the pinion gear 77 rotates in the +S direction, and the third member 73 moves in the +Ya direction.

In the present embodiment, FIG. 18 shows the respective moving distance of the first member 71, the second member 72, and the third member 73 when the support portion 39 has moved from the retracted position shown in FIG. 16 to the advanced position shown in FIG. 18 through the state shown in FIG. 17. When the moving distance of the first member 71 is a distance L1, the moving distance of the second member 72 having a higher moving speed is a distance L2 longer than the distance L1. Further, when the moving distance of the third member 73 with respect to the first member 71 is a distance L3, the total moving distance of the third member 73 is a distance (L1+L3), and is the longest distance among the first member 71, the second member 72, and the third member 73.

The aligning portion 38 is provided at the end of the third member 73 in the −Ya direction as described above. Among the first member 71, the second member 72, and the third member 73 constituting the support portion 39, the aligning portion 38 is provided on the third member 73 having the longest moving distance in the +Ya direction, so that the pushing distance of the medium P in the +Ya direction can be increased.

The movement of the support portion 39 from the advanced position shown in FIG. 18 to the retracted position shown in FIG. 16 is performed by rotating the first gear 74 and the second gear 75 shown in FIG. 14 in the −R direction.

Further, in the present embodiment, the pinion gear 77 is movable to the downstream of the first tray 35 in the +Ya direction, which is the discharge direction of the medium P. Thus, the medium P can be more reliably discharged to the second tray 37.

The position of the support portion 39 can be detected by the support portion detection section 90 shown in FIG. 13. The support portion detection section 90 is provided on the first tray 35 side, and is configured by a transmission type optical sensor as an example.

Next, a push-down section 50 will be described.

In FIGS. 2 and 3, reference numeral 35*c* denotes a rib provided at the end of the first tray 35 in the +Ya direction, and as shown in FIG. 2, the tip end 35*b* in the +Ya direction of the first medium receiving surface 35*a* constituting the first tray 35 is formed at the upper surface corner of the rib 35*c*.

Further, the push-down section 50 is provided in the +Ya direction from the tip end 35*b* of the first medium receiving surface 35*a*. The push-down section 50 mainly includes a guide member 51, a holding member 52, a push-down portion 53, and a coil spring 54 as shown in FIG. 4.

The guide member 51 is provided in a posture along a direction orthogonal to the Ya-axis direction. A plurality of guide portions 51*a* are provided in the guide member 51, and the holding member 52 is supported by the guide portions 51*a* so as to be slidable and displaceable with respect to the guide member 51 in a direction orthogonal to the Ya-axis direction. In FIGS. 2 and 8 to 12, an arrow S indicates a direction orthogonal to the Ya-axis direction, that is, a displacement direction of the holding member 52. Hereinafter, the direction indicated by the arrow S is referred to as "raising-lowering direction S", the lower direction of the elevation direction S is referred to as "lowering direction", and the upward direction is referred to as "raising direction".

Figure 4:
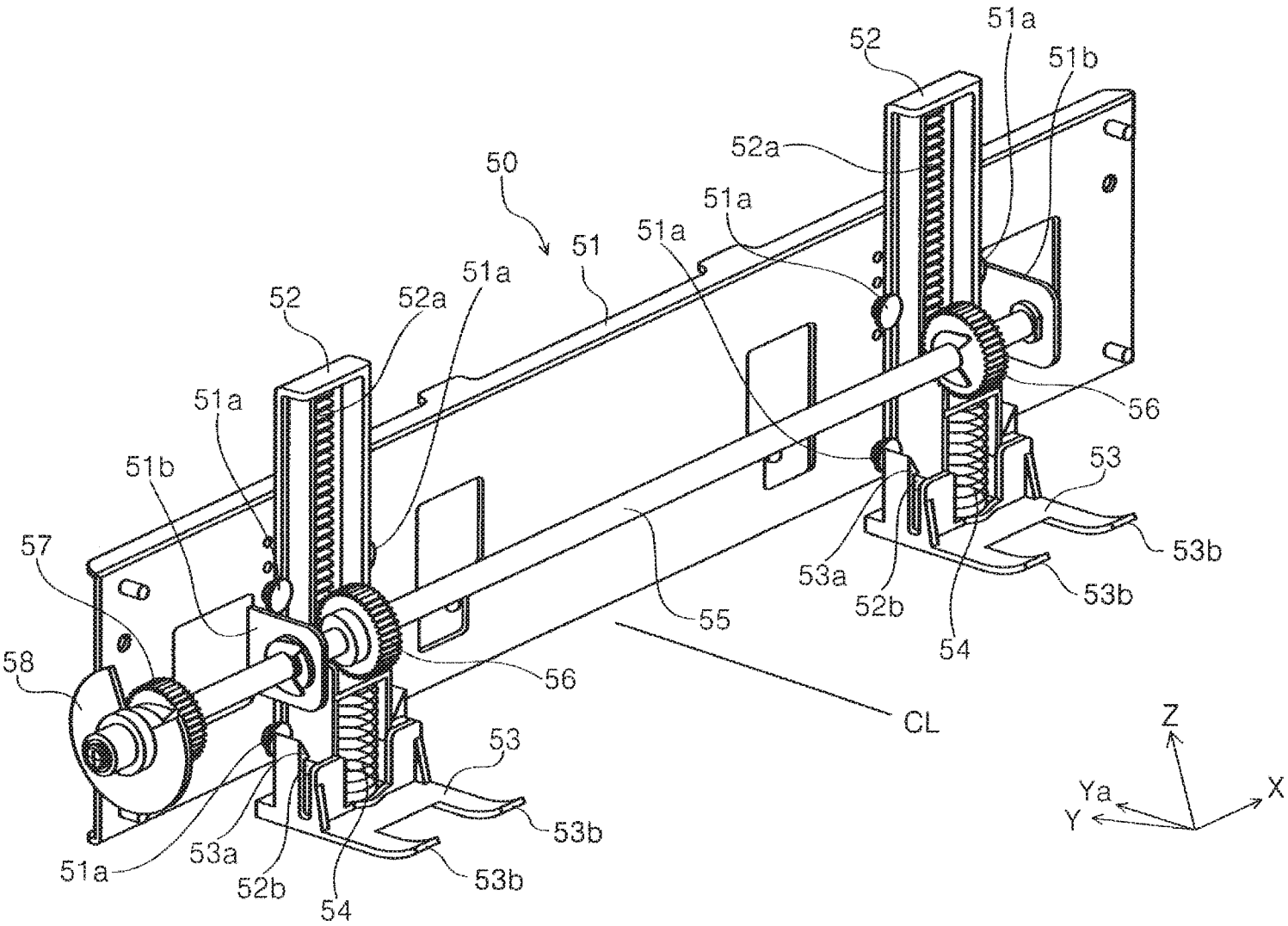
FIG. 4 is a perspective view of the holding section.

In the present embodiment, two holding members 52 are arranged at an interval along the X-axis direction as shown in FIG. 4. In FIG. 4, a straight line CL is a straight line along the Ya-axis direction, and is a straight line passing through the center position of the support portion 39 (see FIG. 3) in the X-axis direction. The two holding members 52 are arranged symmetrically with respect to the straight line CL in the X-axis direction.

A rack 52*a* is formed in the holding member 52 along the raising-lowering direction S, and a pinion gear 56 meshes with the rack 52*a*. The rack 52*a* and the pinion gear 56 constitute a rack and pinion mechanism. The rack and pinion mechanism and a second motor 62 (see FIG. 19) constitute driving section for moving the holding member 52 up and down in the raising-lowering direction S.

The pinion gear 56 is attached to a rotation shaft 55, and a gear 57 and a detected portion 58 are provided at the shaft end of the rotation shaft 55.

Figure 19:
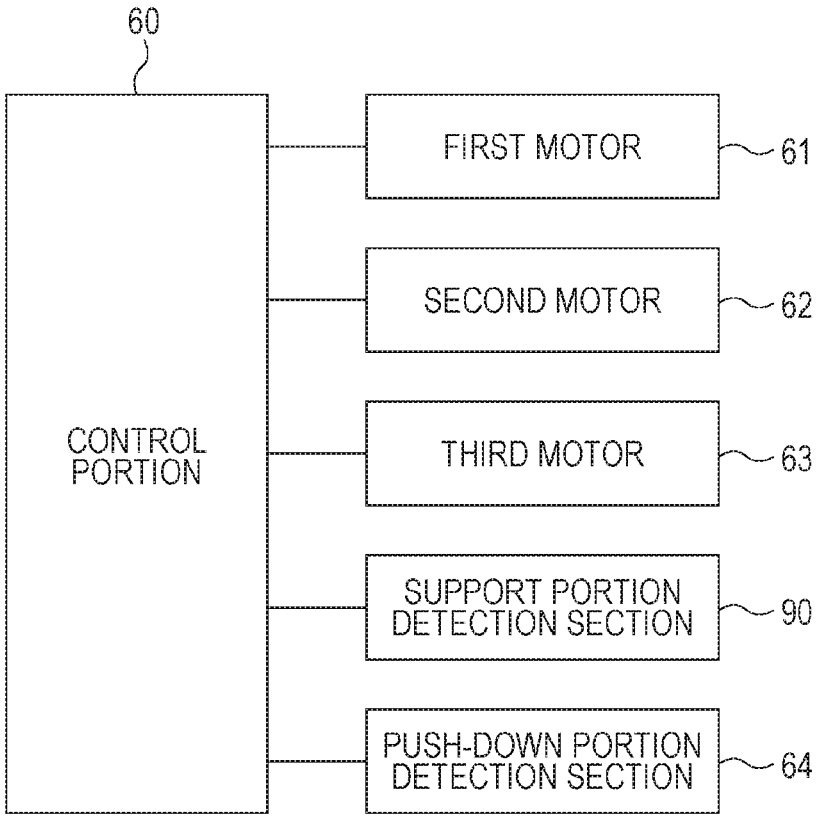
FIG. 19 is a block diagram showing a control system of the medium discharge device.

The gear 57 is a gear driven by the second motor 62 (see FIG. 19). When the driving force of the second motor 62 is transmitted to the gear 57, the rotation shaft 55 and the pinion gear 56 rotate, and the holding member 52 is displaced in the raising-lowering direction S.

The detected portion 58 is a disk constituting the push-down portion detection section 64 (see FIG. 19), and the control portion 60 can grasp the position of the push-down portion 53 described later in the raising-lowering direction S by a change in the detection signal of the push-down portion detection section 64 accompanying the rotation of the detected portion 58.

At the lower end of the holding member 52, the push-down portion 53 is held. A hook 53*a* is formed in the push-down portion 53, and the hook 53*a* is engaged with a stopper 52*b* formed in the holding member 52 so that the push-down portion 53 does not fall off the holding member 52 and can be displaced to some extent in the raising-lowering direction S.

A compression coil spring 54 as a pressing member is provided between the holding member 52 and the push-down portion 53, and the push-down portion 53 is provided in a state in which the push-down portion 53 is pressed in the lowering direction by the compression coil spring 54.

In FIG. 2, under the control of the control portion 60 (see FIG. 19), the push-down portion 53 takes four positions of a raised position S1 where the lower surface of the push-down portion 53 is in the most raising direction, a first restriction position S2, a lowered position S3, and the second restriction position S4. The straight line L1 is a line obtained by extending the first medium receiving surface 35*a* in the +Ya direction. The raised position S1 and the first restriction position S2 are located above the straight line L1, and the lowered position S3 and the second restriction position S4 are located below the straight line L1.

Figure 11:
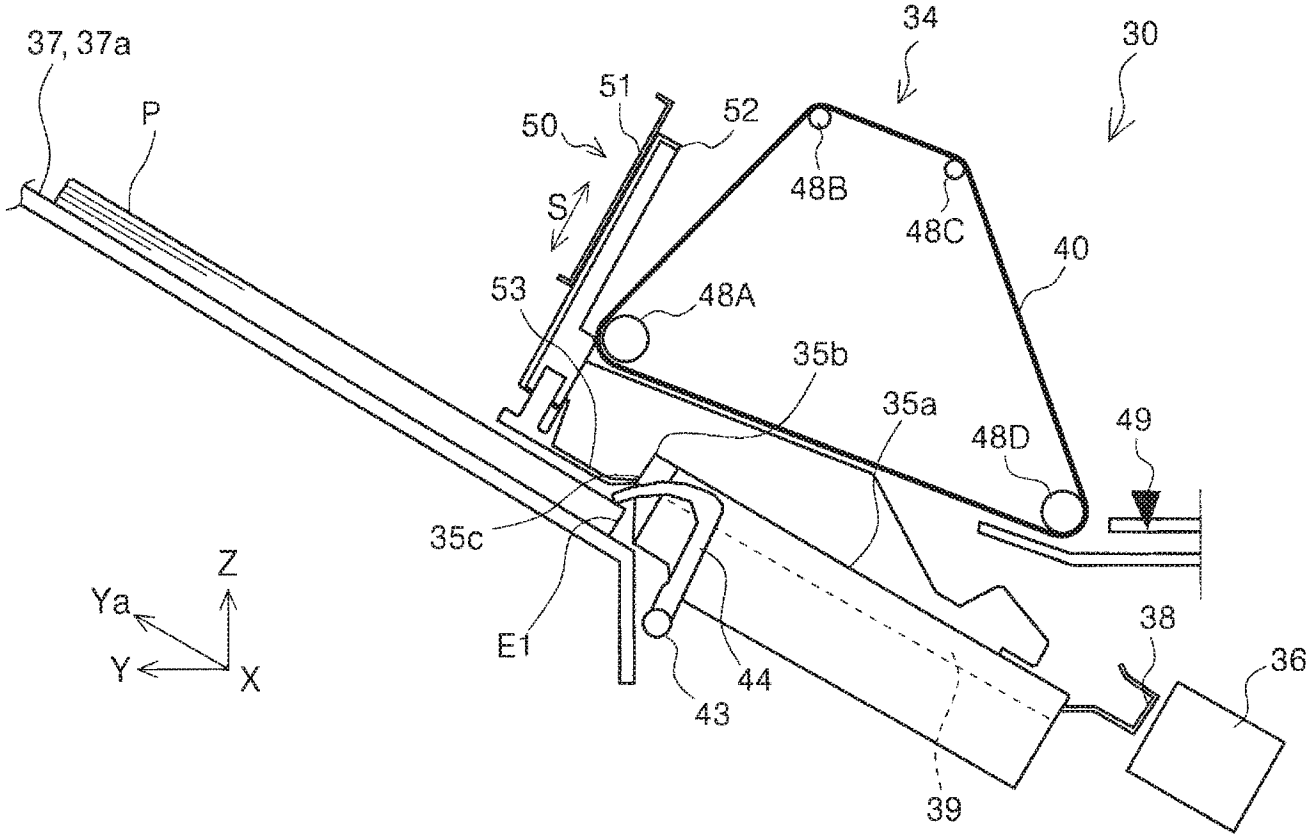
FIG. 11 is a side view of the medium discharge device.

The state in which the push-down portion 53 is at the raised position S1 is shown in FIGS. 2 to 5, 8, and 12. FIGS. 6, 7, 9, and 10 show a state in which the push-down portion 53 is at the lowered position S3. FIG. 11 shows a state in which the push-down portion 53 is at the second restriction position S4.

Under the control of the control portion 60 (see FIG. 19), the push-down portion 53 is displaced from the raised position S1 to the first restriction position S2 every time the medium P is discharged to the first tray 35. That is, the push-down portion 53 is located at the raised position S1 before the medium P is discharged to the first tray 35, and is displaced from the raised position S1 to the first restriction position S2 after the medium P is discharged to the first tray 35. Thereby, the floating of the medium P discharged to the first tray 35 can be appropriately restricted.

Further, in the present embodiment, since the first restriction position S2 is above the straight line L1 extending the first medium receiving surface 35*a* in the +Ya direction, it is possible suppress an excessive external force from being applied to the medium P discharged to the first tray 35.

Figure 20:
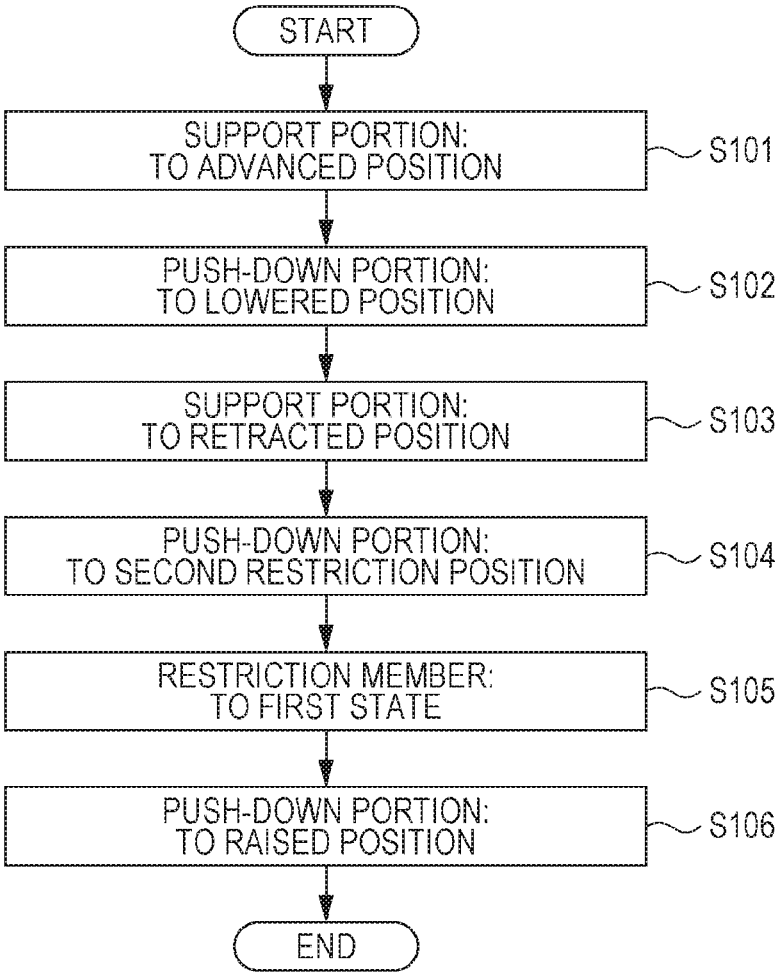
FIG. 20 is a flowchart showing an operation when discharging a medium from the first tray to a second tray.

Hereinafter, the operation when the medium P is discharged from the first tray 35 to the second tray 37 will be described with reference to FIG. 20 and other drawings as necessary. In the state before the medium P is discharged from the first tray 35 to the second tray 37, more specifically, when the processing by the processing portion 36 on the medium P mounted on the first tray 35 is completed, as shown in FIGS. 2 and 3, the support portion 39 is at the retracted position, and the push-down portion 53 is at the raised position. Further, a restriction member 44 described later is in a second state.

Figure 5:
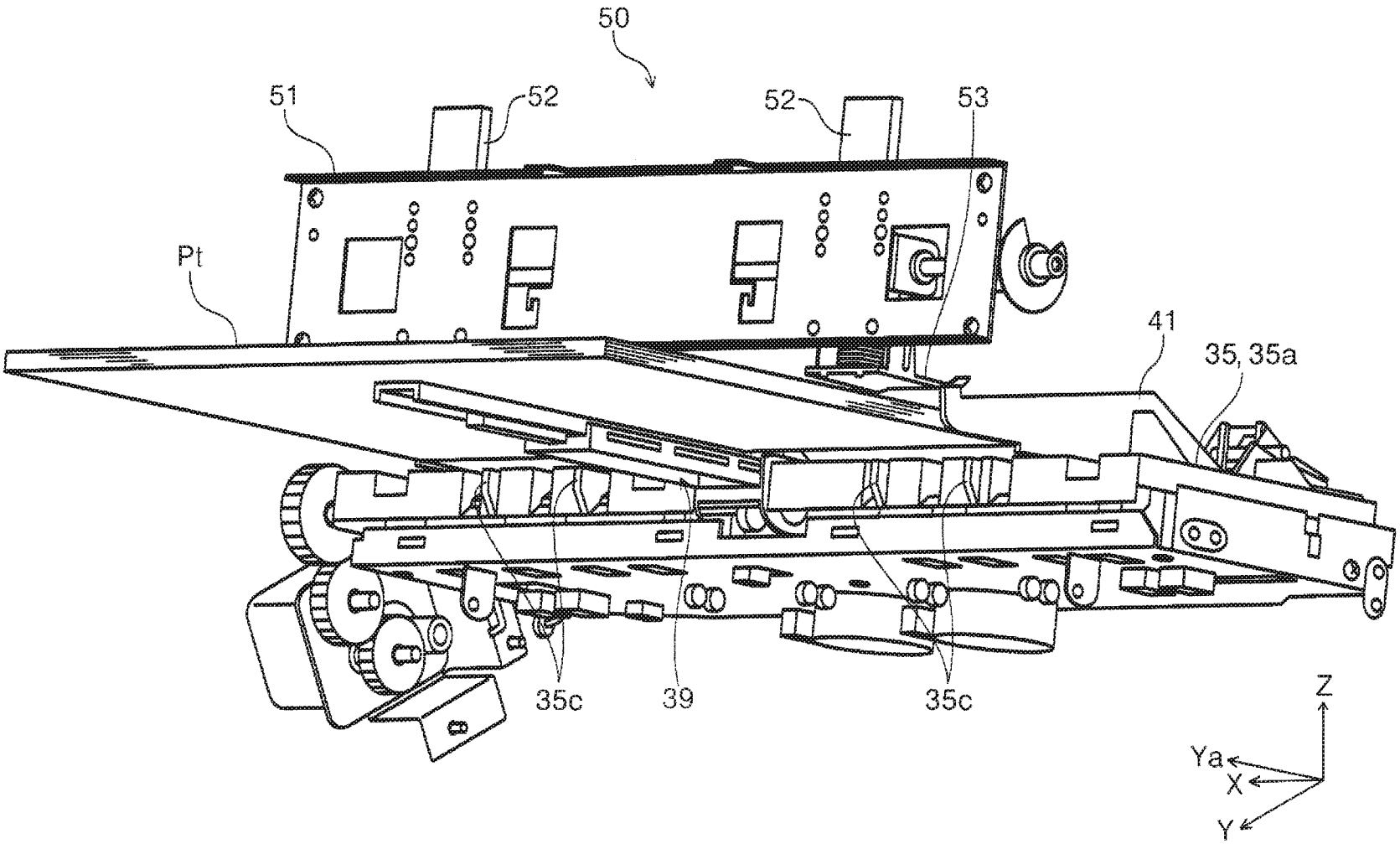
FIG. 5 is a perspective view of the holding section, the first tray, and the support portion.
Figure 8:
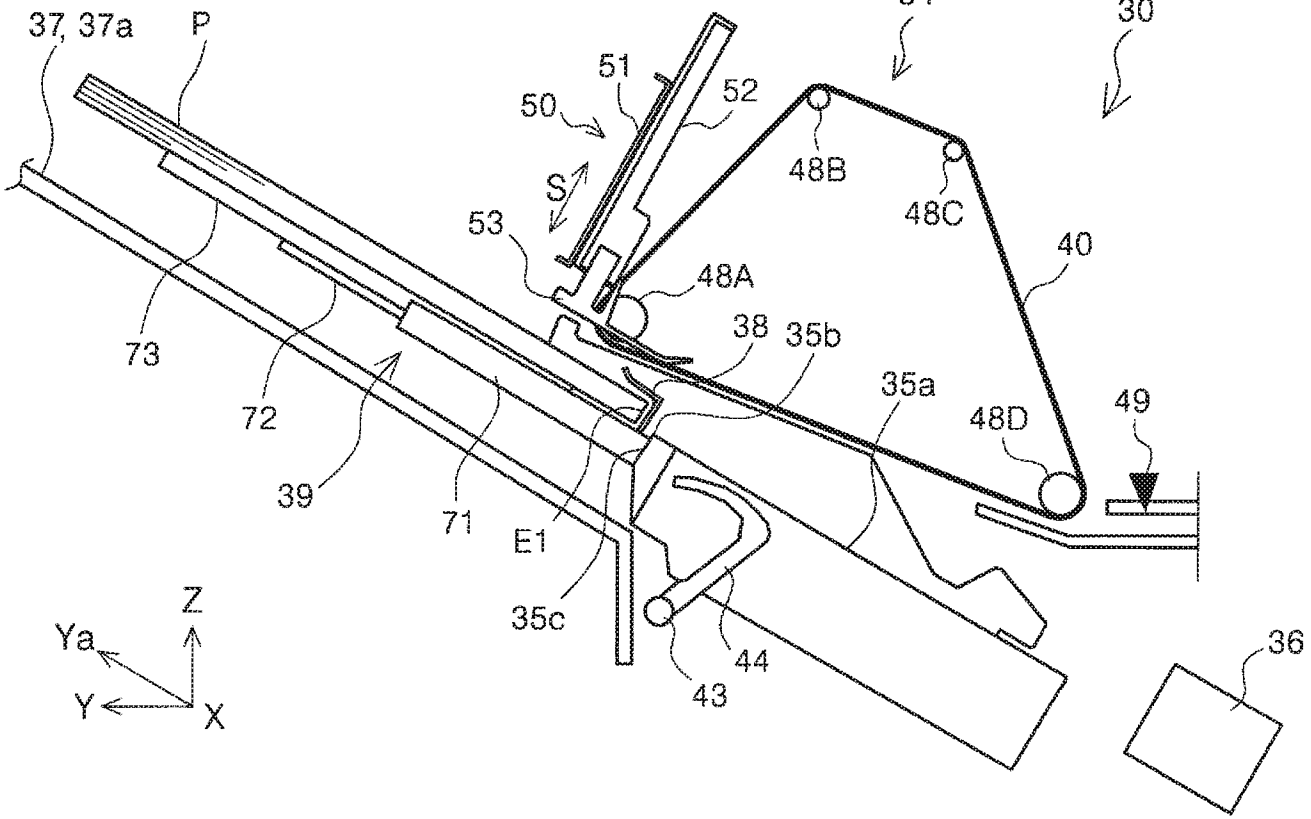
FIG. 8 is a side view of the medium discharge device.

When discharging the medium P from the first tray 35 to the second tray 37 from this state, the control portion 60 first displaces the support portion 39 from the retracted position to the advanced position (step S101). FIGS. 5 and 8 show a state in which the support portion 39 has been displaced from the retracted position to the advanced position. When the support portion 39 is displaced from the retracted position to the advanced position, the medium P moves from the first tray 35 to above the second tray 37.

Figure 6:
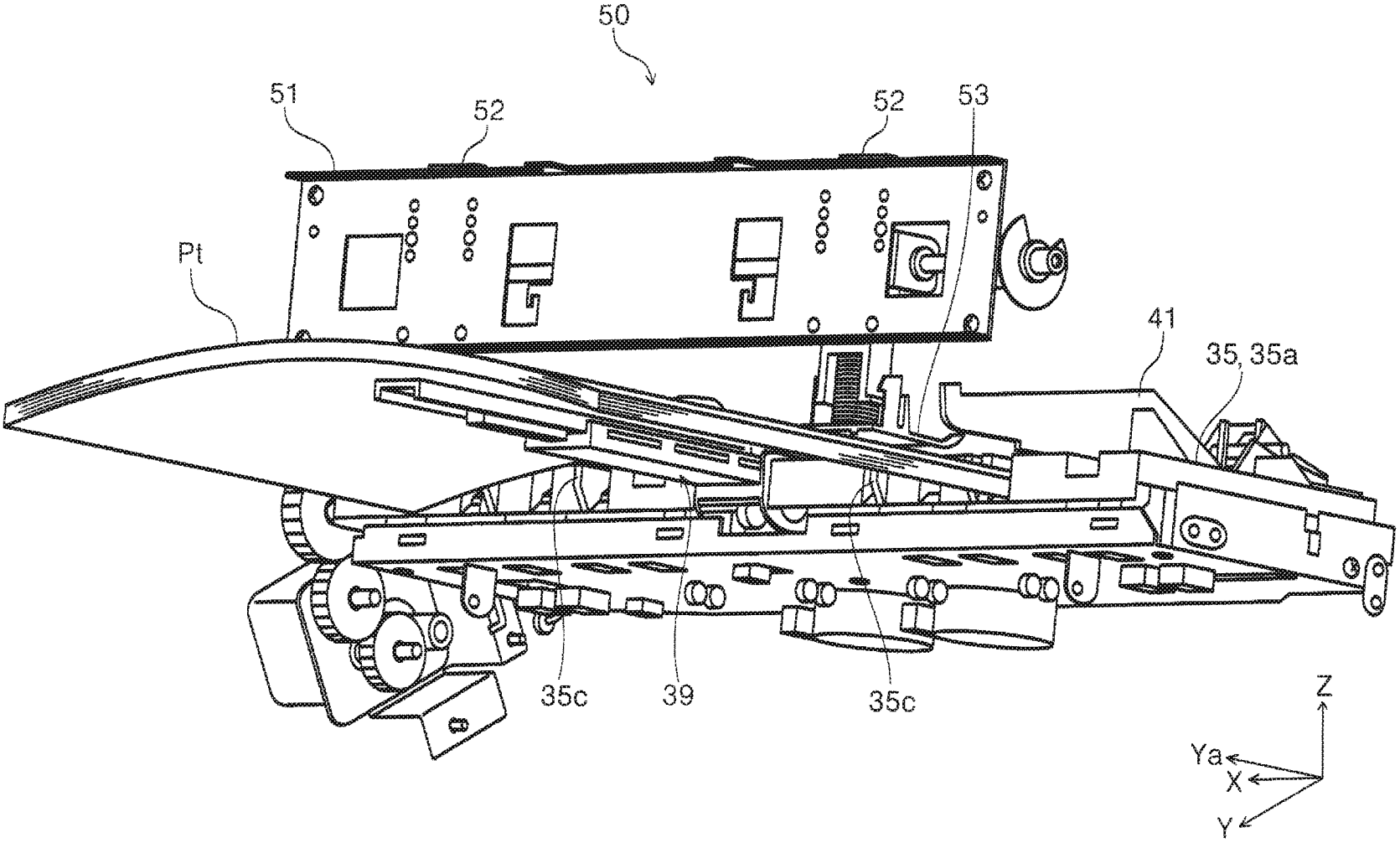
FIG. 6 is a perspective view of the holding section, the first tray, and the support portion.
Figure 7:
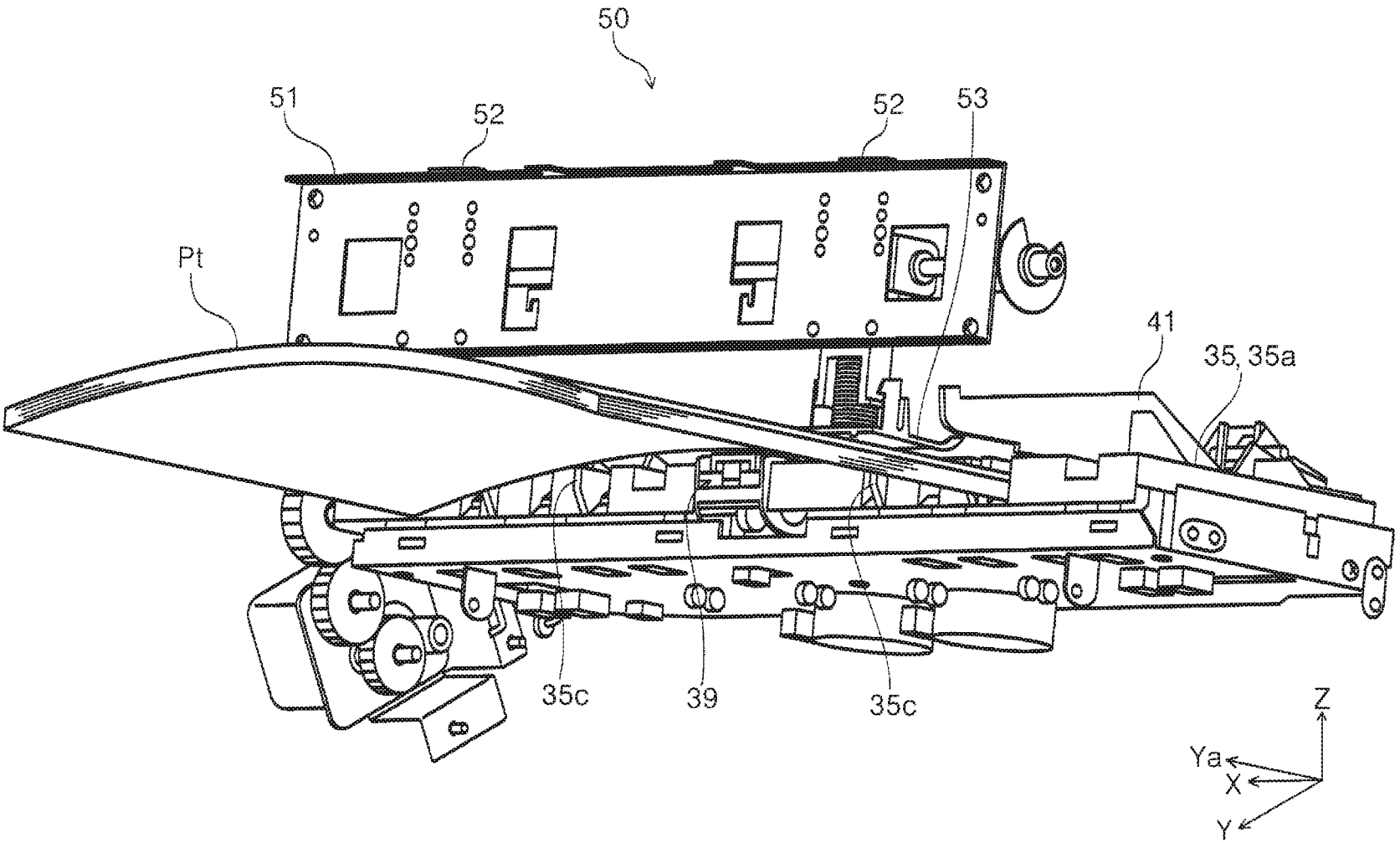
FIG. 7 is a perspective view of the holding section, the first tray, and the support portion.
Figure 9:
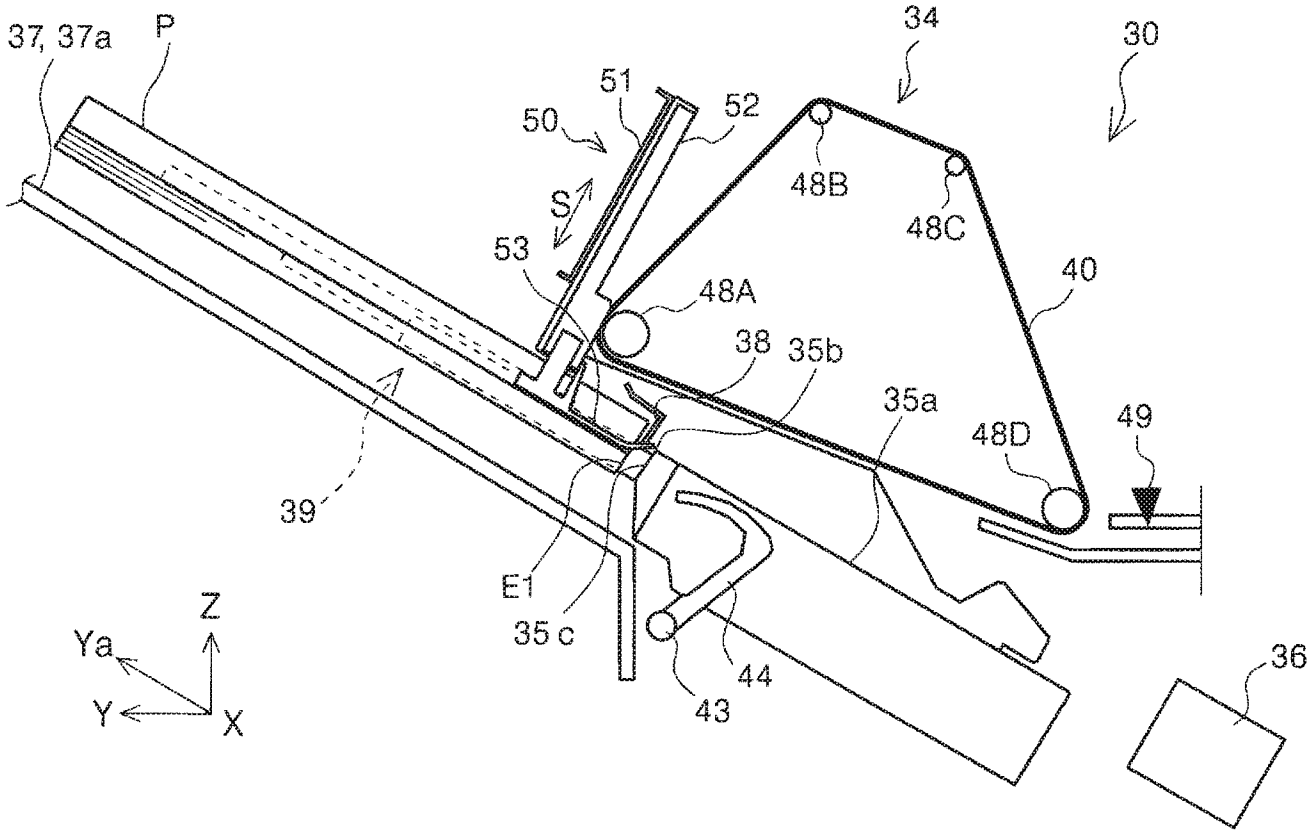
FIG. 9 is a side view of the medium discharge device.
Figure 10:
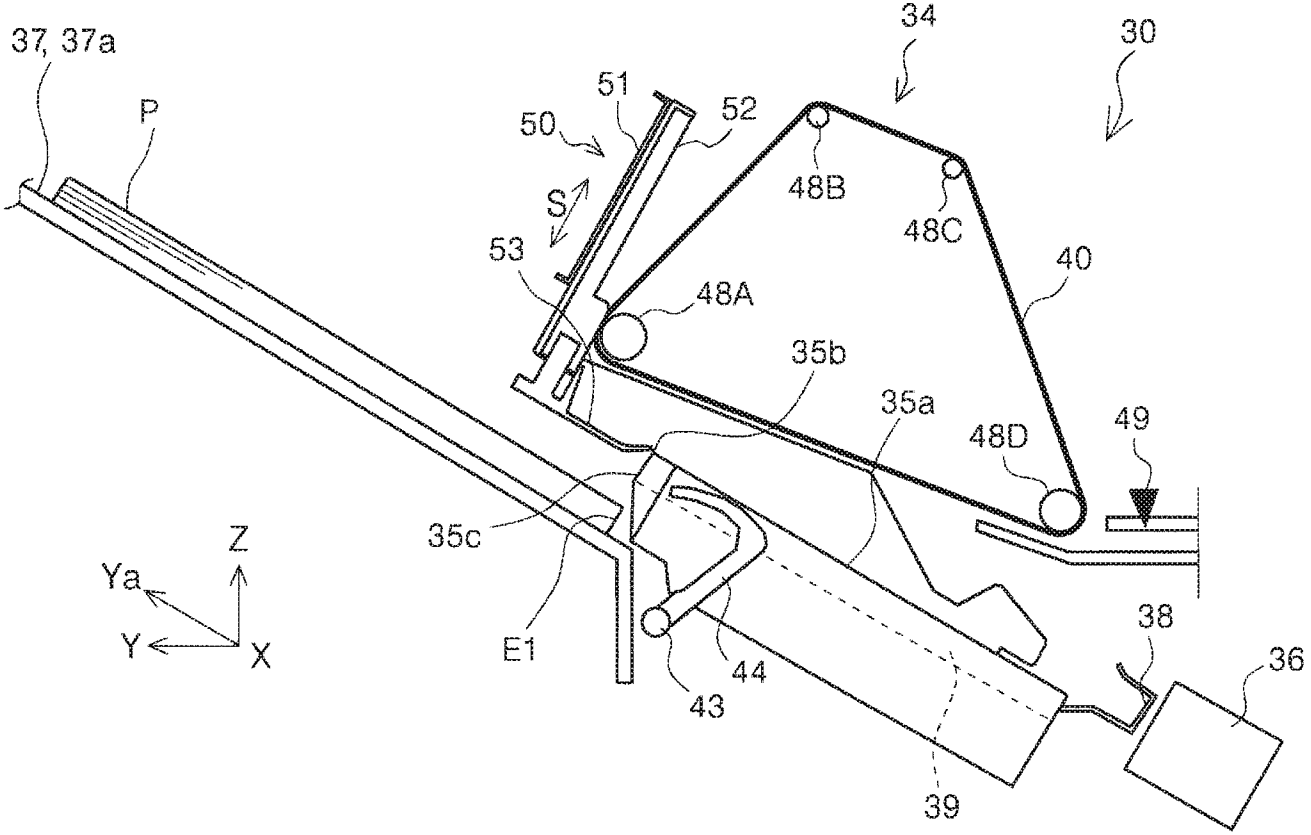
FIG. 10 is a side view of the medium discharge device.

Next, the control portion 60 displaces the push-down portion 53 from the raised position S1 to the lowered position S3 (Step S102). FIGS. 6 and 9 show a state in which the push-down portion 53 is displaced from the raised position S1 to the lowered position S3. In the present embodiment, as described with reference to FIG. 2, the lowered position S3 of the push-down portion 53 is set to be further in a lowering direction than the straight line L1 extending the first medium receiving surface 35*a* of the first tray 35 in the discharge direction in the raising-lowering direction S. Accordingly, the medium P supported by the support portion 39 is pushed down by the push-down portion 53, and the medium P is formed into a curved shape that is upwardly convex so as to be top at the position of the support portion 39. As a result, both ends of the support portion 39 in the −Ya direction end of the medium P are displaced downward from the first tray 35 as shown in FIG. 6 in the X-axis direction.

The lowered position S3 of the push-down portion 53 can be said to be a position where the push-down portion 53 overlaps the support portion 39 when viewed from the X-axis direction.

Next, the control portion 60 returns the support portion 39 from the advanced position to the retracted position (step S103). When the support portion 39 returns from the advanced position to the retracted position, the medium P is released from the support state by the support portion 39, so that the medium P falls on the second tray 37 as shown in a change from FIG. 9 to FIG. 10. At this time, as described above, since the end of the medium P in the −Ya direction is in a state where both sides of the support portion 39 are displaced downward from the first tray 35 in the X-axis direction, the end of the medium P in the −Ya direction can be prevented from being caught on the first tray 35. Further, when returning the support portion 39 from the advanced position to the retracted position, since the end of the medium P which has come off under the first tray 35 in the −Ya direction can abut on the rib 35*c* provided at the end of the first tray 35 in the +Ya direction, the medium P falls smoothly onto the second tray 37 without being pulled back to the first tray 35 together with the support portion 39.

Next, the control portion 60 lowers the push-down portion 53 to the second restriction position S4 below the lowered position S3 (step S104), and then switches the restriction member 44 from the second state to the first state (step S105).

Here, the second restriction position S4 of the push-down portion 53 is a height obtained by adding a predetermined margin to the maximum stacking height of the media P on the second tray 37 in the present embodiment. In this manner, the floating of the medium P mounted on the second tray 37 is restricted by the downward movement of the push-down portion 53 from the lowered position S3 to the second restriction position S4.

Here, the restriction member 44 will be described. The restriction member 44 is provided on the rotation shaft 43, and the rotation shaft 43 is rotated by the driving force of a third motor 63 (see FIG. 19) under the control of the control portion 60. Accordingly, the restriction member 44 can rotate in the clockwise and the counterclockwise direction in FIGS. 8 to 12.

The restriction member 44 can take a first state (see FIGS. 11 and 12) in which the floating of the medium P mounted on the second tray 37 can be restricted by opposing the upstream area in the −Ya direction and a second state (see FIGS. 2 and 8 to 10) in which the medium P is separated from the position facing the medium P mounted on the second tray 37.

Figure 12:
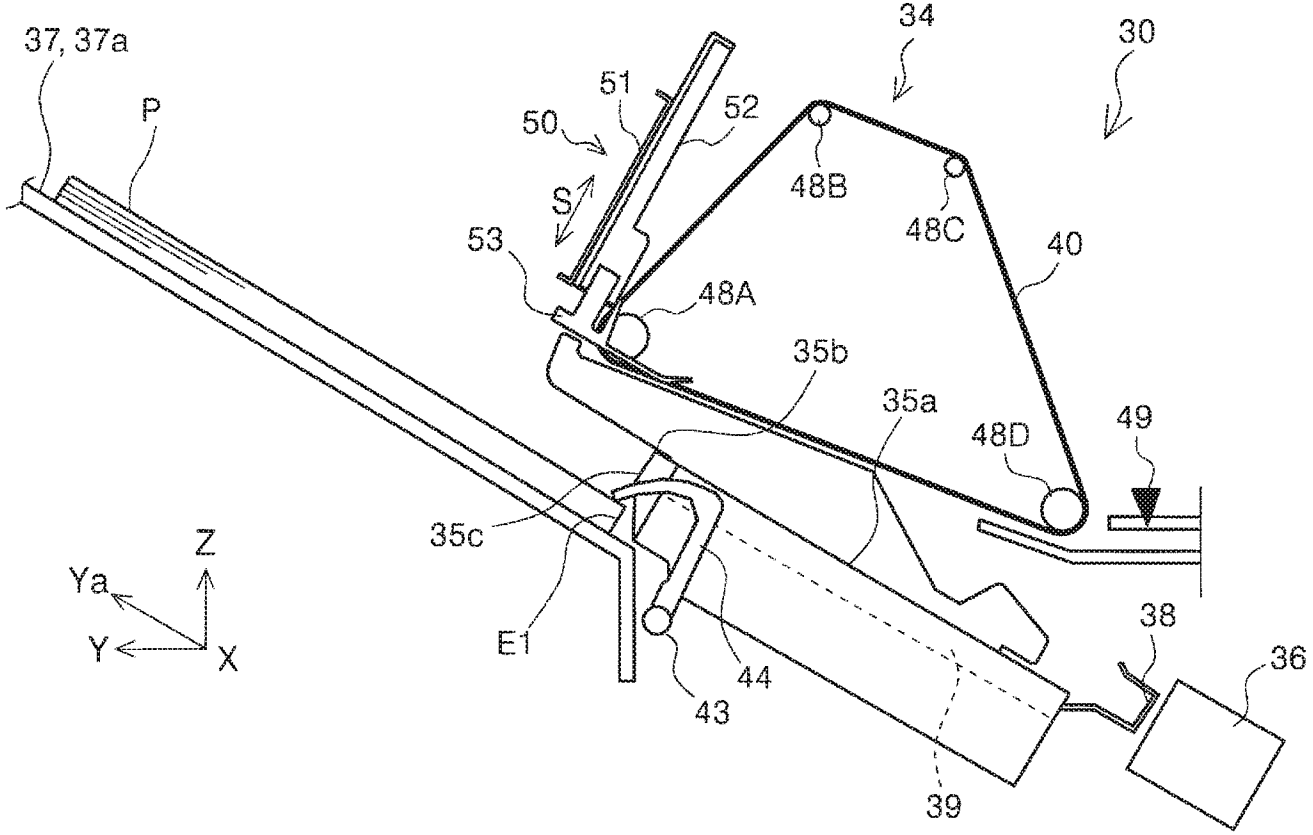
FIG. 12 is a side view of the medium discharge device.

After switching the restriction member 44 from the second state to the first state, the control portion 60 returns the push-up portion 53 to the raised position as shown by the change from FIG. 11 to FIG. 12 (step S106). Thus, even after the push-up portion 53 returns to the raised position, the floating of the medium P from the second tray 37 is restricted by the restriction member 44.

The features of the above-described embodiment are summarized as follows.

First, the medium discharge device 30 includes a first tray 35 having a first medium receiving surface 35*a* for receiving the medium P, a second tray 37 having a second medium receiving surface 37*a* for receiving the medium P discharged from the first tray 35, a support portion 39 displaceable between a retracted position located in the first tray 35 and an advanced position advanced from the retracted position in the medium discharge direction from the first tray 35 to the second tray 37 and is located on the second tray 37 and supports the medium P, and an aligning portion 38 provided in the support portion 39 for aligning an upstream end in the discharge direction of the medium P supported by the support portion 39. Further, a push-down portion 53 that is located downstream of a downstream end of the first medium receiving surface 35*a* in the medium discharge direction, and that is located at a place deviated from the support portion 39 in a width direction that is a direction intersecting with the medium discharge direction, and pushes down a part of an upstream end of the medium P supported by the support portion 39 positioned at an advanced position in the medium discharge direction below the downstream end of the first medium receiving surface 35*a* in the medium discharge direction is provided.

Thereby, when discharging the medium P from the first tray 35 to the second tray 37, it is possible to suppress a problem that the rear end of the medium P is caught on the first tray 35. Further, when returning the support portion 39 from the advanced position to the retracted position, since the end of the medium P which has come off under the first tray 35 in the −Ya direction can abut on the rib 35*c* provided at the end of the first tray 35 in the +Ya direction, the medium P can be properly dropped on the second tray 37 without being pulled back to the first tray 35 together with the support portion 39.

Further, the push-down portion 53 is configured to displace a part of the upstream end of the medium P in the medium discharge direction in the width direction to a lowered position S3 for pushing down the first medium receiving surface 35*a* below a downstream end in the medium discharge direction and a raised position S1 which is a position above the lowered position S3 and which is separated from the medium P supported by the support portion 39 located at the advanced position, and the raised position S1 is a position above a height position of a downstream end of the first medium receiving surface 35*a* in the medium discharging direction. Thus, when the medium P is moved from the first tray 35 to the second tray 37, it is possible to prevent the push-down portion 53 from being in the way.

In the present embodiment, the lowered position S3 of the push-down portion 53 is set to be lower than the first medium receiving surface 35*a* of the first tray 35 in the raising-lowering direction S, but it is not necessarily lower than the first medium receiving surface 35*a*. For example, it may be set at the same position as the first medium receiving surface 35*a* in the raising-lowering direction S, or may be set in the raising direction so as to be higher than the first medium receiving surface 35*a* in the raising-lowering direction S. That is, it is only necessary that the medium P can be pushed down so that at least the lowest medium P among the plurality of stacked media P falls below the first medium receiving surface 35*a* of the first tray 35.

The push-down section 50 includes the push-down portions 53 on both sides of the support portion 39 in the width direction which is a direction intersecting the discharge direction. Thereby, when the medium P is discharged from the first tray 35 to the second tray 37, the occurrence of the phenomenon that the upstream end of the medium P in the medium discharge direction is caught on the downstream end of the first medium receiving surface 35*a* can be more reliably suppressed.

In the present embodiment, the push-down section 50 includes two push-down portions 53, but may include only one push-down portion 53, or may include three or more push-down portions. At that time, in addition to providing a plurality of pieces in the width direction, a plurality of pieces may be provided along the discharge direction.

The push-down portion 53 is displaced from the raised position to the lowered position after the support portion 39 is displaced from the retracted position to the advanced position, and is displaced from the lowered position to the raised position after the support portion 39 is displaced from the advanced position to the retracted position. Thus, the medium P can be reliably dropped on the second tray 37.

The push-down section 50 includes a holding member 52 that supports the push-down portion 53 and can be displaced along the raising-lowering direction S. The push-down portion 53 is provided so as to be displaceable along the raising-lowering direction S with respect to the holding member 52. At the same time, the push-down portion 53 is provided in a state in which the push-down portion 53 is pressed in a direction toward the lowered position by the compression coil spring 54 as a pressing member. Thereby, it is possible to suppress the push-down portion 53 from excessively pressing against the medium P. In particular, when the rigidity of the medium P is high and it is difficult to bend, or when the stacking amount of the medium P is large, the medium P can be pushed down appropriately.

In the above-described embodiment, the push-down portion 53 is provided so as to be displaceable in the raising-lowering direction S with respect to the holding member 52, but may be provided fixedly.

In addition, the push-down section 50 includes a holding member 52 that supports the push-down portion 53 and can be displaced in the raising-lowering direction S, and a driving section that displaces the holding member 52 in the raising-lowering direction S. The raised position S1 and the lowered position S3 of the push-down portion 53 can be adjusted according to the situation. For example, when the rigidity of the medium P is high and it is difficult to bend, or when the stacking amount of the medium P is large, the lowered position S3 is set to be higher than in other cases, so that the push-down portion 53 can be prevented from pressing against the medium P excessively strongly, and the medium P can be appropriately pushed down.

Further, the push-down section 50 is mounted on the second tray 37 in a first state in which the medium P mounted on the second tray 37 is opposed to the upstream area in the discharge direction and can be prevented from floating in the upstream area. Since the restriction member 44 which can take a second state separated from the position facing the medium P is provided, the restriction member 44 is mounted on the second tray 37 even after the push-down portion 53 returns from the second restriction position to the raised position. The floating of the medium P in the upstream area in the discharge direction can be restricted.

The raised position S1 of the push-down portion 53 is set to a position obtained by adding a predetermined margin to the maximum stacking height of the media P on the first tray 35. As a result, the raised position S1 is set to the minimum necessary height, and the time required for the displacement of the push-down portion 53 can be suppressed, and the throughput can be suppressed.

Further, since the support portion 39 is in a non-projecting state from the tip end of the first medium receiving surface 35*a* in the discharge direction in the first tray 35 at the retracted position, when the medium P is discharged from the first tray 35 to the second tray 37, it is possible to prevent the upstream end in the discharge direction of the medium P from being caught on the support portion 39.

In addition, since the push-down portion 53 has a shape in which the upstream end 53*b* in the discharge direction is warped upward, the push-down portion 53 is mounted on the first tray 35 when discharging the medium P to the first tray 35 or by the support portion 39. It is possible to suppress the possibility that the downstream end of the medium P in the discharging direction is caught by the push-down portion 53 when the medium P is moved downstream in the discharging direction.

The push-down portion 53 is further lowered from the lowered position S3, and can take a second restriction position S4 where the floating of the medium P mounted on the second tray 37 can be restricted so that the floating of the medium P on the second tray 37 can be appropriately restricted.

Further, since the push-down portion 53 faces the upstream area of the medium P mounted on the second tray 37 in the discharge direction, the floating of the medium P mounted on the second tray 37 in the upstream area in the discharge direction can be suitably restricted.

In the present embodiment, the processing unit 4 can be regarded as a "medium processing apparatus" including the medium discharge device 30 and a processing portion 36 that executes a predetermined process on the medium P mounted on the first tray 35. Further, the recording system 1 can be regarded as a "medium processing apparatus" including the medium discharge device 30 and a processing portion 36 that executes a predetermined process on the medium P mounted on the first tray 35. Further, a device in which the recording function is omitted from the recording system 1 can be regarded as a "medium discharge device". Alternatively, even if a recording function is provided, the recording system 1 itself can be regarded as a medium discharge device from the viewpoint of medium discharge.

Further, the present disclosure is not limited to the above-described embodiment, and various modifications are possible within the scope of the disclosure described in the claims, and it goes without saying that they are also included in the scope of the present disclosure.

What is claimed is:

1. A medium discharge device comprising:

a first tray having a first medium receiving surface for receiving a medium;

a second tray having a second medium receiving surface for receiving the medium discharged from the first tray;

a discharge section that discharges the medium disposed on the first tray to the second tray; and a push-down portion that is located downstream of a downstream end of the first medium receiving surface in a medium discharge direction, and that is located at a place deviated from the discharge section in a width direction that is a direction intersecting with the medium discharge direction, and pushes down a part in the width direction of an upstream end of the medium to be discharged in the medium discharge direction below the downstream end of the first medium receiving surface in the medium discharge direction, wherein the discharge section has a support portion that supports the medium and is displaceable between a retracted position located in the first tray and an advanced position advanced from the retracted position in the medium discharge direction from the first tray to the second tray and is located over the second tray, and the push-down portion pushes down the medium supported by the support portion located at the advanced position.

2. The medium discharge device according to claim 1, wherein the push-down portion is configured to displace between a lowered position for pushing down a part in the width direction of the upstream end of the medium in the medium discharge direction to below the downstream end of the first medium receiving surface in the medium discharge direction and a raised position which is a position above the lowered position and which is separated from the medium supported by the support portion located at the advanced position, and the raised position is a position above a height position of the downstream end of the first medium receiving surface in the medium discharging direction.

3. The medium discharge device according to claim 2, wherein the push-down portion is provided on both sides of the support portion in the width direction.

4. The medium discharge device according to claim 2, wherein the push-down portion is displaced from the raised position to the lowered position after the support portion is displaced from the retracted position to the advanced position, and is displaced from the lowered position to the raised position after the support portion is displaced from the advanced position to the retracted position.

5. The medium discharge device according to claim 2, further comprising:

a holding member that holds the push-down portion and is configured to be displaced along a displacement direction between the raised position and the lowered position, wherein the push-down portion is provided so as to be displaceable with respect to the holding member along the displacement direction between the raised position and the lowered position and is pressed by a pressing member in a direction toward the lowered position.

6. The medium discharge device according to claim 2, further comprising:

a holding member that holds the push-down portion and is configured to be displaced along a displacement direction between the raised position and the lowered position; and a driving section that displaces the holding member along the displacement direction.

7. The medium discharge device according to claim 2, wherein the push-down portion is displaceable to a first restriction position that restricts floating of the medium mounted on the first tray, and every time the medium is discharged to the first tray, the push-down portion is displaced from the raised position to the first restriction position.

8. The medium discharge device according to claim 2, further comprising:

a restriction member configured to take a first state which faces upstream area of the medium mounted on the second receiving surface of the second tray in the medium discharge direction and restricts floating of the upstream area and a second state separated from a position facing the medium mounted on the second medium receiving surface of the second tray.

9. The medium discharge device according to claim 2, wherein the raised position of the push-down portion is set to a value obtained by adding a predetermined margin to a maximum stacking height of the medium on the first tray.

10. The medium discharge device according to claim 2, wherein the support portion is in a non-projecting state from the downstream end of the first medium receiving surface in the medium discharge direction at the retracted position.

11. The medium discharge device according to claim 2, wherein the push-down portion has a shape in which the upstream end in the medium discharge direction is warped upward.

12. The medium discharge device according to claim 2, wherein the push-down portion is configured to take a second restriction position further lowered from the lowered position, and capable of restricting floating of the medium mounted on the second tray.

13. The medium discharge device according to claim 12, wherein the push-down portion faces an upstream area of the medium mounted on the second medium receiving surface of the second tray in the medium discharge direction.

14. A medium processing apparatus comprising:

the medium discharge device according to claim 1; and a processing portion that performs a predetermined process on the medium mounted on the first tray.

15. A recording system comprising:

a recording unit including a recording section that performs recording on a medium; and a processing unit including the medium discharge device according to claim 1 that discharges the medium after recording in the recording unit and a processing portion that performs a predetermined processing on the medium mounted on the first tray.

* * * * *